US006167227A

United States Patent [19]

Fujita et al.

[11] Patent Number: 6,167,227

[45] Date of Patent: Dec. 26, 2000

[54] DEVELOPING UNIT AND IMAGE FORMING APPARATUS

[75] Inventors: Syouichi Fujita; Itaru Kawabata, both of Kashiba; Toshio Nishino, Yamatokoriyama; Hirofumi Sakita, Tenri; Hideji Saiko, Nara; Mitsuru Tokuyama, Kyoto, all of Japan

[73] Assignee: Sharp Kabushiki Kaisha, Osaka, Japan

[21] Appl. No.: 09/421,118

[22] Filed: Oct. 19, 1999

[30] Foreign Application Priority Data

Oct. 19, 1998 [JP] Japan ..... 10-297271

[51] Int. Cl.[7] ..... G03G 15/08

[52] U.S. Cl. ..... 399/258; 399/259; 399/260; 399/359

[58] Field of Search ..... 399/252, 254, 399/358, 359, 360, 120, 258, 259, 260

[56] References Cited

U.S. PATENT DOCUMENTS 5,128,724 7/1992 Hayashi et al. ..... 399/119
5,493,382 2/1996 Takagaki et al. .

FOREIGN PATENT DOCUMENTS 59-166264 11/1984 Japan .
6-110329 4/1994 Japan .
9-236978 9/1997 Japan .

*Primary Examiner*—William J. Royer

[57] ABSTRACT

A developing unit and an image forming apparatus includes drive and control mechanisms for the conveyance of collected toner and fresh toner in an uncomplicated structure and an uncomplicated toner supplying roller structure for the reduction in manufacturing cost. Fresh toner and collected toner stored in housing parts of a toner housing are discharged from an outlet via openings formed in a partitioning member for forwarding to a developing section by a toner supplying roller disposed to confront the outlet. The toner supplying roller is provided in common to fresh toner and collected toner. The toner supplying roller includes a single rotary shaft and a plurality of composite members which are fit into the rotary shaft. Each of the composite members has a cylindrical hollow body and a cylindrical elastic body which is fit onto the outer peripheral surface of the hollow body. The composite members are disposed correspondingly to the housing parts.

12 Claims, 21 Drawing Sheets

CELL DENSITY OF SUPPLYING ROLLER AND FRESH TONER DEPOSIT AMOUNT 3b
10
33a
11n
12n
13n
35a
34a

DEVELOPING UNIT AND IMAGE FORMING APPARATUS

BACKGROUND OF THE INVENTION

1. Field of the Invention

The present invention relates to a developing unit for rendering a latent image formed on an image carrier visible. The present invention further relates to an image forming apparatus (e.g., a printer, facsimile apparatus, and copier) which includes such a developing unit and employs either an electrophotographic process or an electrostatic recording process.

2. Description of the Related Art

In an image forming apparatus (e.g., a printer, facsimile apparatus, and copier) employing either an electrophotographic process or an electrostatic recording process, a toner as a developer is deposited by a developing unit onto an electrostatic latent image formed on a photoconductor (i.e., an image carrier) for rendering the electrostatic latent image visible. The deposited toner is transferred to a sheet of copy paper and fixed thereon for image formation.

In an image forming process of the type described above, most of the toner deposited on an electrostatic latent image formed on a photoconductor is transferred to a copy sheet and used up there, while a portion of the deposited toner, i.e., residual toner remaining on the photoconductor, is collected by cleaning means. How much of the deposited toner remains on a photoconductor is susceptible to ambient conditions. For example, the efficiency of image transfer falls in a hot humid environmental situation, as a result of which greater amounts of toner become residual toner particles.

Further, a small amount of toner is deposited or adhered to some regions of the photoconductor other than the region where the electrostatic latent image is formed. Such toner, which lingers in the regions without being transferred to a copy sheet, is collected by the cleaning means.

Further, in order to perform toner concentration control, a toner image of reference toner concentration is formed on the photoconductor. Such a toner image, which is not transferred to a copy sheet, is collected by the cleaning means.

The amount of toner subject to the above-described toner collection by the cleaning means amounts up to about twenty percent of the total.

Meanwhile, in consideration of making good utilization of resources, there have been proposed mechanisms for reusing collected toner. The reuse of collected toner not only contributes to an increase in copy volume but also saves time and labor for the disposal of waste toner.

For instance, Japanese Unexamined Utility Model Publication JP-U 59-166264 (1984) discloses that collected toner is discharged by discharging means of a cleaning unit and conveyed by relay conveying means to a toner supplying hopper. On the other hand, fresh toner is conveyed to the toner supplying hopper by another conveying means different from the relay conveying means for collected toner. The collected toner and fresh toner are mixed together by mixing means. The mixture of toner is supplied to a developing unit from the toner supplying hopper. In JP-U 59-166264, the collected-toner conveying means, the fresh-toner conveying means, and the collected toner/fresh toner mixing means are all required.

For example, Japanese Unexamined Patent Publication JP-A 6-110329 (1994) discloses that collected toner is fed to a toner hopper which contains fresh toner, and the toner in the toner hopper is supplied to a developing unit by a toner supplying roller. Additionally, fresh toner is supplied to the toner hopper from a toner container. Such arrangement produces the problem that collected and fresh toners cannot be mixed with each other successfully. Whereas fresh toner held in a fresh-toner hopper is supplied to the developing unit by a fresh-toner supplying roller, collected toner held in a collected-toner hopper is supplied to the developing unit by a collected-toner supplying roller. These toner supplying rollers are required as collected-toner conveying means and as fresh-toner conveying means, respectively.

Japanese Unexamined Patent Publication JP-A 9-236978 (1997) discloses that fresh toner is supplied to a toner mixing section from a toner supplying section and in addition to the fresh toner, collected toner collected by a toner recycling mechanism is delivered to the toner mixing section. The collected toner and the fresh toner are mixed together in the toner mixing section. Thereafter, the mixture of toner is supplied to a developing unit. In JP-A 9-236978, the toner supplying unit is required, and besides, the toner mixing unit is needed.

A developing unit of the type described above and an image forming apparatus having such a developing unit however produce some problems. For example, the number of components is relatively large and the size becomes larger, which results in an increase in the manufacturing cost. Additionally, the conveyance of collected toner and fresh toner is done using separate driving means and the control thereof is performed individually. Therefore, both the driving mechanism and the control mechanism become complicated.

SUMMARY OF THE INVENTION

Hence an object of the present invention is to provide a developing unit and an image forming apparatus in which driving and control mechanisms for conveying collected toner and fresh toner are simplified and a toner supplying roller is structurally simplified, for the purpose of reduction in manufacturing cost.

The present invention provides a developing unit comprising:

developing means for depositing a developer on a latent image formed on an image carrier to develop the latent image, developer supplying means for supplying a developer to the developing means, developer collecting means for collecting residual developer remaining on the image carrier and delivering the collected residual developer to the developer supplying means, wherein the developer supplying means includes a developer housing and a developer supplying roller, wherein the developer housing has an outlet through which the developer held in the developer housing is discharged, and is divided by a partitioning member into two housing parts of which one is to store fresh developer and the other is to store the collected developer, which partitioning member has openings in communication with the outlet so that each of the fresh developer and the collected developer is discharged through the outlet, and wherein the developer supplying roller is disposed to confront the outlet of the developer housing, and includes a single rotary shaft and a plurality of composite members fit to the rotary shaft, which plurality of composite members each comprise a cylindrical hollow body and a cylindrical elastic body fit to an outer peripheral surface of the hollow body, and are provided so as to correspond to the housing parts, respectively.

In accordance with the present invention, the fresh developer held in one of the housing parts of the developer housing and collected developer held in the other housing part are let out from the outlet through the openings defined in the partitioning member and supplied to the developing means by the developer supplying roller disposed to confront the outlet. The developer supplying roller is provided in common for collected developer and fresh developer, which makes it possible to simplify drive and control mechanisms to the developer supplying roller. Additionally, the developer supplying roller is constructed in a relatively easy manner, that is, it is formed by inserting the rotary shaft into the hollow body with the elastic body fit thereto. Therefore, the cost for manufacturing a developing unit can be reduced. Accordingly, the present invention is able to provide an inexpensive developing unit.

In the invention it is preferable that the elastic bodies of the plurality of composite members are formed of different cellular materials having different cell densities.

In accordance with the present invention, the elastic bodies of the composite members, which are disposed correspondingly to the housing parts, respectively, are formed of different cellular materials which differ from each other in cell density. Such arrangement makes it possible to realize and place a single developer supplying roller having elastic bodies suitable for the fresh developer held in one of the housing parts (the first housing part) and for the collected developer held in the other housing part (the second housing part), respectively. Further, the fresh developer held in the first housing material is discharged from a part of the elastic body suitable for the fresh developer, while the collected developer held in the second housing part is discharged from a part of the elastic body suitable for the collected developer. This provides some advantages. For example, it is possible to supply to the developing means an optimal mixture of the collected developer and fresh developer.

In the invention it is preferable that there is formed an engaging portion at both ends of the respective hollow bodies of the composite members, for linking the hollow bodies together.

In accordance with the present invention, adjoining hollow bodies are linked to each other by the engaging portion, whereby the drive of the rotary shaft can be transmitted to all the hollow bodies.

Furthermore, in the invention it is preferable that the rotary shaft and the respective hollow bodies are provided with a slip-preventing member so that the hollow bodies fit to the rotary shaft are prevented from slipping.

In accordance with the present invention, by virtue of the provision of the slip-preventing members for the rotary shaft and the respective hollow bodies, the hollow bodies are prevented from slipping over the rotary shaft, therefore further ensuring the drive transmission of the rotary shaft.

In the invention it is preferable that adjoining end surfaces of the elastic bodies of the composite members are adhered to each other.

In accordance with the present invention, elastic bodies next to each other are adhered together at their end surfaces. As a result of such arrangement, the deterioration of edges of the elastic bodies due to rotational stress can be prevented.

Further, in the invention it is preferable that the end surface of the elastic body of each composite member projects beyond an end surface of the hollow body thereof.

In accordance with the present invention, when a plurality of composite members are fit into the rotary shaft, projecting end surfaces of the elastic bodies are brought into close contact with one another. This accordingly prevents the occurrence of a difference in level due to a gap and expansion between adjoining elastic bodies and expansion, thereby preventing the supplied developer from leaking and further preventing the developer supplying roller from deteriorating.

The present invention provides a developing unit comprising:

developing means for depositing a developer on a latent image formed on an image carrier to develop the latent image, developer supplying means for supplying a developer to the developing means, developer collecting means for collecting residual developer remaining on the image carrier and delivering the collected residual developer to the developer supplying means, wherein the developer supplying means includes a developer housing and a developer supplying roller, wherein the developer housing has an outlet through which the developer held in the developer housing is discharged, and is divided by a partitioning member into two housing parts of which one is to store fresh developer and the other is to store the collected developer, which partitioning member has openings in communication with the outlet so that each of the fresh developer and the collected developer is discharged through the outlet, and wherein the developer supplying roller is disposed to confront the outlet of the developer housing, and includes rotary shaft members which are linked to each other to form a rotary shaft, and a plurality of elastic members fit to the rotary shaft members, respectively, and the elastic members are provided so as to correspond to the housing parts, respectively.

In accordance with the present invention, both the fresh developer and the collected developer respectively held in the housing parts of the developer housing are discharged from the outlet via the openings defined in the partitioning member and supplied by the developer supplying roller to the developing means. By virtue of the developer supplying roller which is provided in common for the collected developer and the fresh developer, the drive and control mechanisms of the developer supplying roller can be simplified. Further, the developer supplying roller can be constructed by linking rotary shaft members having elastic members fit thereto, to each other. Therefore, the developer supplying roller can be constructed in a relatively easy manner and by a less number of components. The present invention is able to achieve reductions in the manufacturing cost of developing units, thereby providing inexpensive developing units.

In the invention it is preferable that the elastic members are formed of different cellular materials having different cell densities.

In accordance with the present invention, the elastic members corresponding to the housing parts are formed of different cellular materials which differ from each other in cell density. Such arrangement makes it possible to realize and place a developer supplying roller having elastic members suitable for the fresh developer held in one of the housing parts and for the collected developer held in the other housing parts, respectively. This provides some advantages. For example, it is possible to supply to the developing means an optimal mixture of the collected developer and fresh developer.

In the invention it is preferable that adjoining end surfaces of the elastic members are adhered to each other.

In accordance with the present invention, elastic members next to each other are adhered together at their end surfaces. As a result of such arrangement, the deterioration of edges of the elastic members due to rotational stress can be prevented.

In the invention it is preferable that the end surface of each elastic member projects beyond an end surface of the corresponding rotary shaft member.

In accordance with the present invention, when a plurality of elastic members are fit into a rotary shaft member, projecting end surfaces of the elastic members are brought into close contact with each other. This accordingly prevents the occurrence of a difference in level due to a gap and expansion between adjoining elastic members and expansion, thereby preventing the supplied developer from leaking and further preventing the developer supplying roller from deteriorating.

Further, the present invention provides an image forming apparatus comprising the above-described developing unit.

In accordance with the present invention, it becomes possible to realize an inexpensive image forming apparatus comprising the above-described developing unit which is simple in drive mechanism, control mechanism, and structure.

BRIEF DESCRIPTION OF THE DRAWINGS

Other and further objects, features, and advantages of the invention will be more explicit from the following detailed description taken with reference to the drawings wherein:

FIGS. 11A and 11B are diagrams showing a toner supplying roller 3*b*, wherein FIG. 11A is a cross section of the toner supplying roller 3*b* taken in a direction perpendicular to a rotary shaft 10 and FIG. 11B is a cross section of the toner supplying roller 3*b* taken in a direction in parallel with the rotary shaft 10;

FIGS. 12A and 12B are diagrams showing a toner supplying roller 3*c*, wherein FIG. 12A is a cross section of the toner supplying roller 3*c* taken in a direction perpendicular to the rotary shaft 10 and FIG. 12B is a cross section of the toner supplying roller 3*c* taken in a direction in parallel with the rotary shaft 10;

FIGS. 13A and 13B are diagrams showing a toner supplying roller 3*d*, wherein FIG. 13A is a cross section of the toner supplying roller 3*d* taken in a direction in parallel with the rotary shaft 10 and FIG. 13B is a perspective view of the toner supplying roller 3*d;*

DETAILED DESCRIPTION OF THE PREFERRED EMBODIMENTS

Figure 1:
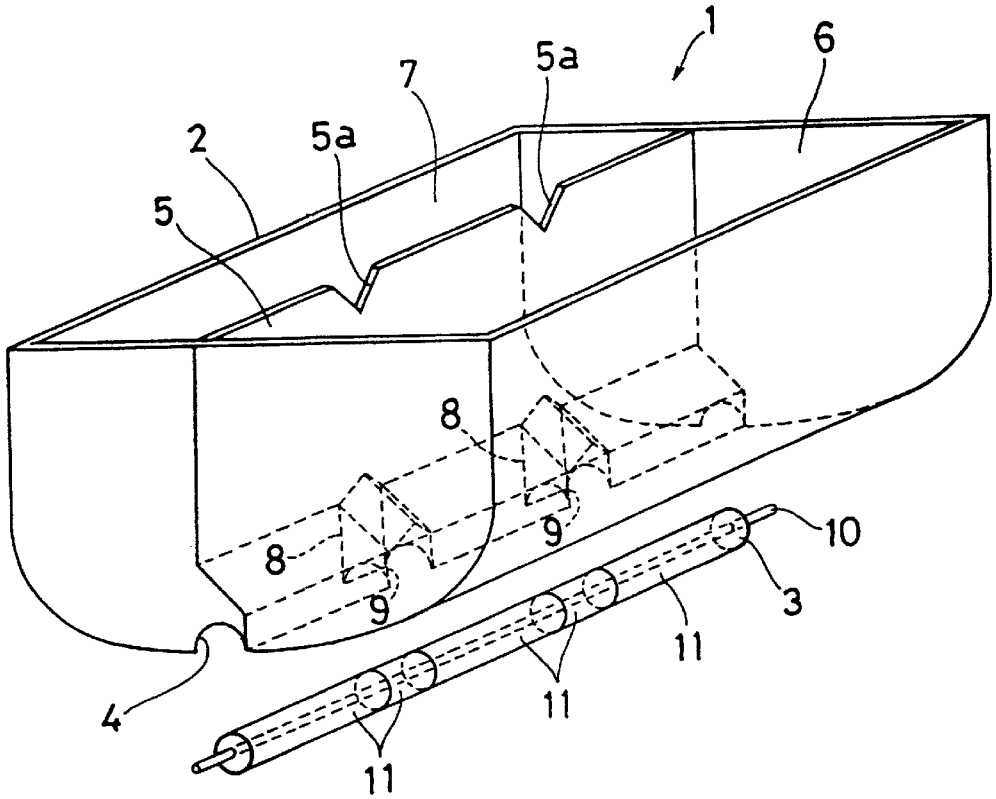
FIG. 1 is a perspective view showing a toner supplying section 1 of a developing unit 17 as a first embodiment of the present invention.

Now referring to the drawings, preferred embodiments of the invention are described below.

Figure 2:
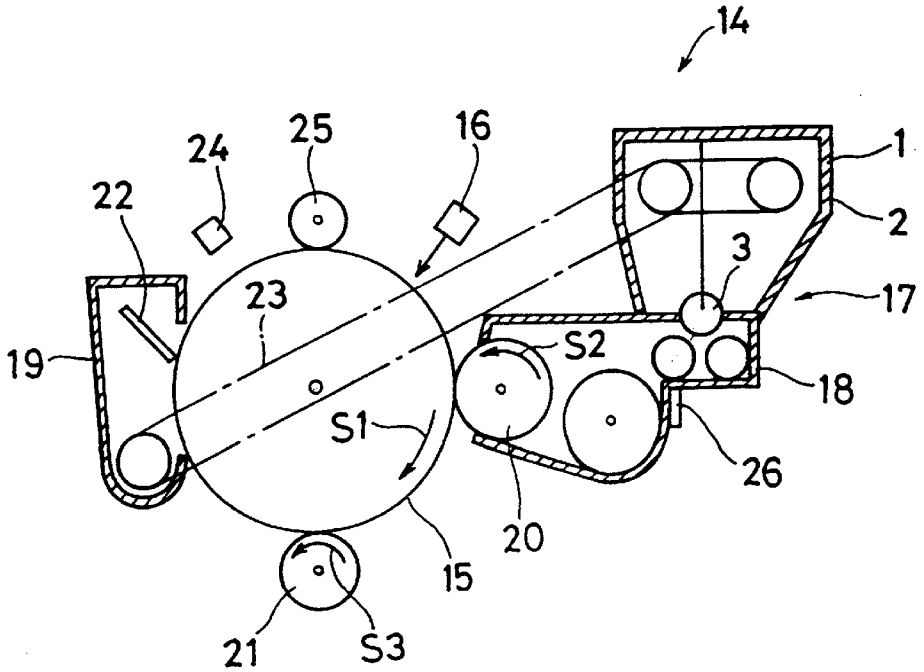
FIG. 2 is a cross-sectional view showing an image forming apparatus 14 having the developing unit 17.
Figure 3A:
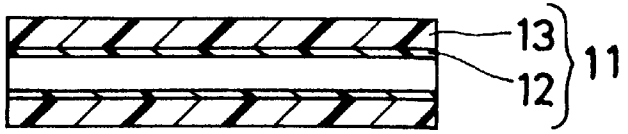
FIGS. 3A–3C are cross-sectional views showing a toner supplying roller 3 of the toner supplying section 1.
Figure 3B:
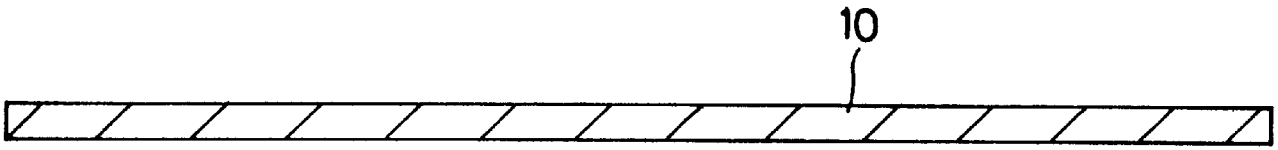
Figure 3C:
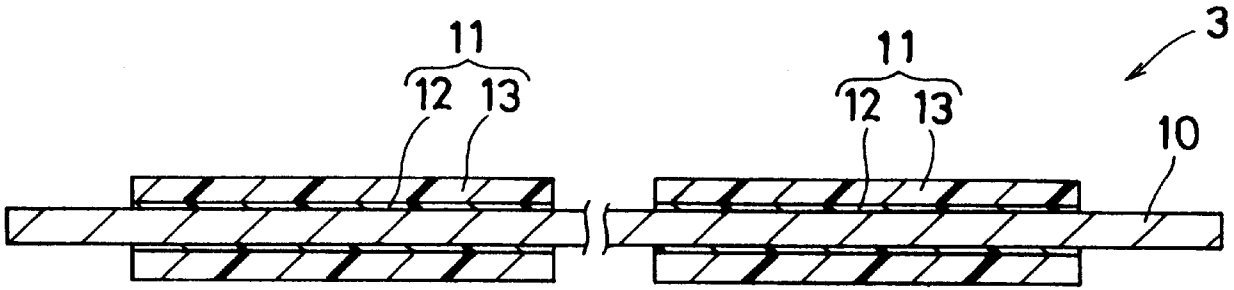

FIG. 1 is a perspective view illustrating a toner supplying section 1 mounted in a developing unit 17 as a first embodiment of the present invention. FIG. 2 is a cross-sectional view showing an image forming apparatus 14 which comprises the developing unit 17. FIGS. 3A–3C are cross-sectional views of a toner supplying roller 3 mounted on the toner supplying section 1. Referring first to FIG. 2, the image forming apparatus 14 will be described. On a photoconductor drum 15 as an image carrier which is constructed rotatably in a direction S1 and electrostatically charged to a predetermined potential by a charger 25 described later, is formed an electrostatic latent image of an image to be formed by an exposure unit 16. For the exposure unit 16 are employed, for example, a laser type using semiconductor laser, an LED type using LED array, and a liquid crystal shutter type using a liquid crystal shutter.

Toner as a developer is adhered to the formed electrostatic latent image by a developing section 18 of the developing unit 17 disposed on the downstream side in a rotational direction of the drum with respect to the exposure unit 16, whereby the electrostatic latent image will be developed. Toner is supplied to the developing section 18 from the toner supplying section 1 of the developing unit 17. The toner thus supplied is fed onto the photoconductor drum 15 by a developing roller 20 which is disposed to confront the photoconductor drum 15 and constructed rotatably in a direction S2 opposite to the rotational direction S1 of the photoconductor drum 15. Further, on the opposite side of the developing section 18 with respect to the photoconductor drum 15 is disposed a concentration detecting sensor 26 of a magnetic permeability type capable of detecting a toner concentration, for example.

The toner adhered to the photoconductor drum 15 is transferred to transfer material (e.g., a sheet of paper conveyed by predetermined conveying means) and fixed thereon by a fixing roller 21 disposed so as to contact with the photoconductor drum 15 on the downstream side in the rotational direction of the drum with respect to the developing section 18.

On the downstream side in the rotational direction of the drum with respect to the fixing roller 21 is disposed a toner collecting section 19 of the developing unit 17 for collecting residual toner remaining on the photoconductor drum 15 after the transfer and fixing of toner. The toner collecting section 19 is provided with a cleaning blade 22 in contact with the photoconductor drum 15. Residual toner is cleaned and collected by the cleaning blade 22. The collected toner is fed to the toner supplying section 1 via a collected-toner conveying path 23 of the toner collecting section 19.

On the downstream side in the rotational direction of the drum with respect to the toner collecting section 19 is disposed an electric charge eliminator 24 for removing residual electric charges remaining on the surface of the photoconductor drum 15, and further downstream is disposed the charger 25 for charging the surface of the photoconductor drum 15 to a predetermined potential.

Referring next to FIGS. 1 and 3A–3C, the toner supplying section 1 of the developing unit 17 will be described. The toner supplying section 1 includes a toner housing 2 in addition to the toner supplying roller 3. At the bottom mid section of the toner housing 2 is disposed an outlet 4 through which toner stored in the toner housing 2 is let out. The outlet 4 of the toner housing 2 is formed to confront a toner supplying opening of the developing section 18. The housing section of the toner housing 2 is divided into two sections, i.e., a housing part 6 and a housing part 7, by a partitioning member 5 which is set upright from the vicinity of the outlet 4. Whereas the housing part 6 stores fresh toner, the housing part 7 stores collected toner. In order to discharge fresh toner and collected toner through the outlet 4, openings 8 and 9 in communication with the outlet 4 are formed in the partitioning member 5.

The toner supplying roller 3 is disposed to confront the outlet 4 of the toner housing 2. The toner supplying roller 3 is a sectional roller. For example, the toner supplying roller 3 includes a single rotary shaft 10 and a plurality of composite members 11 which are fit to the rotary shaft 10. Each of the composite members 11 is composed of a hollow body 12 such as a cylindrical pipe and a cylindrical elastic body 13 fit to the outer peripheral surface of the hollow body 12. The rotary shaft 10 is inserted into an empty space of the hollow body 12. Each of the composite members 11 is provided correspondingly to the housing parts 6 and 7, respectively.

The rotary shaft 10 is implemented by a rigid shaft obtained by performing nickel or chrome plating on carbon steel or a rigid metallic shaft of aluminum or stainless steel. The hollow body 12 is implemented by an approximately pipe-shaped molded hollow body of resin or by an approximately pipe-shaped thin hollow body of aluminum or stainless steel. It is preferred that the elastic body 13 is made of sponge or polyurethane foam of the ester or ether type.

Figure 4:
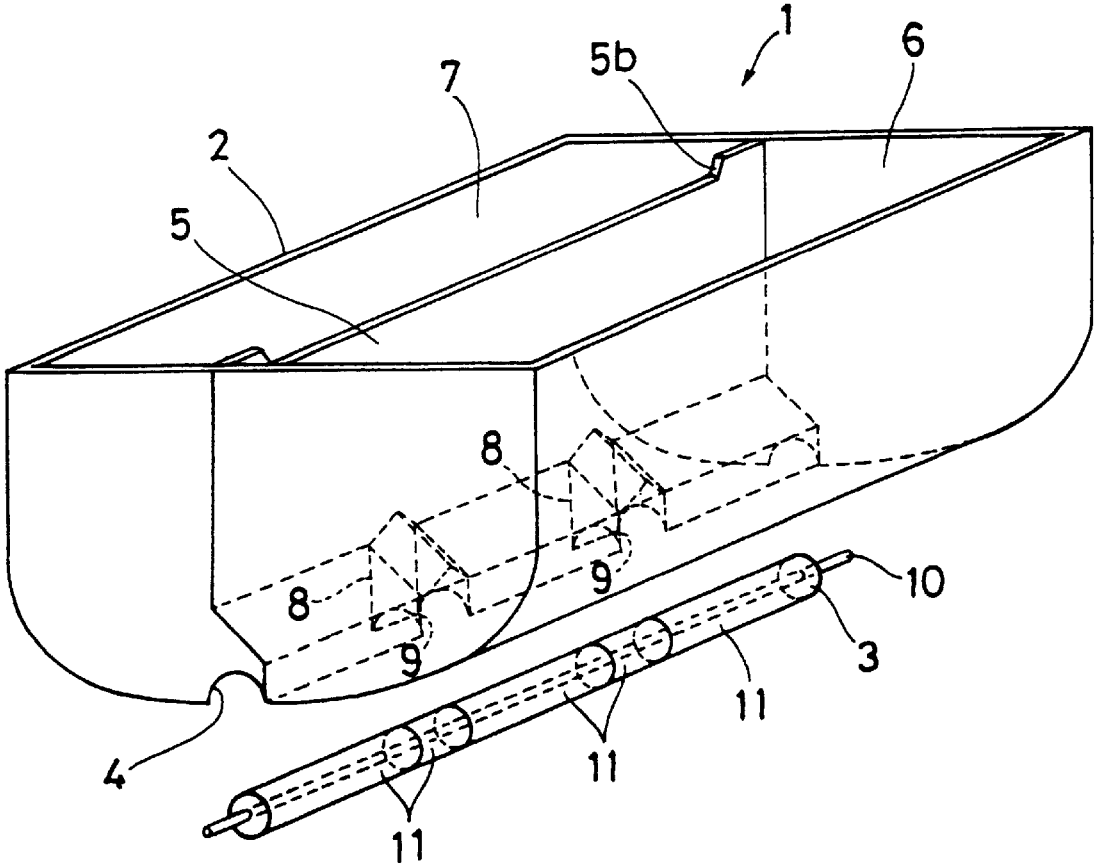
FIG. 4 is a perspective view showing another toner supplying section 1 of the developing unit 17.

FIG. 4 is a perspective view showing another toner supplying section 1 mounted in the developing unit 17. Whereas the partitioning member 5 of the toner supplying section 1 shown in FIG. 1 is provided with a plurality of notches 5*a* (the number of notches is two in the present embodiment), the partitioning member 5 of the toner supplying section 1 shown in FIG. 4 is provided with a single notch 5*b*.

Each notch 5*a* and 5*b* is formed for the reason that when the housing part 7 for storing collected toner is filled with collected toner to its capacity, the collected toner overflows into the housing part 6 for holding fresh toner, whereby the toner amount can be controlled.

The toner supplying roller 3 is provided in common to collected toner and fresh toner. The collected toner and the fresh toner are mixed. The toner mix is fed to the developing section 18. This accordingly provides much simplified drive and control mechanisms to the toner supplying roller 3 in the developing unit 17 or in the image forming apparatus 14 in comparison with the case where toner supplying rollers are provided individually for collected toner and for fresh toner. Further, the toner supplying roller 3 can be constructed relatively easily. Accordingly, the manufacturing cost of the developing unit 17 or the image forming apparatus 14 can be reduced. In this way, it becomes possible to realize the developing unit 17 or the image forming apparatus 14 at lower costs.

Figure 5:
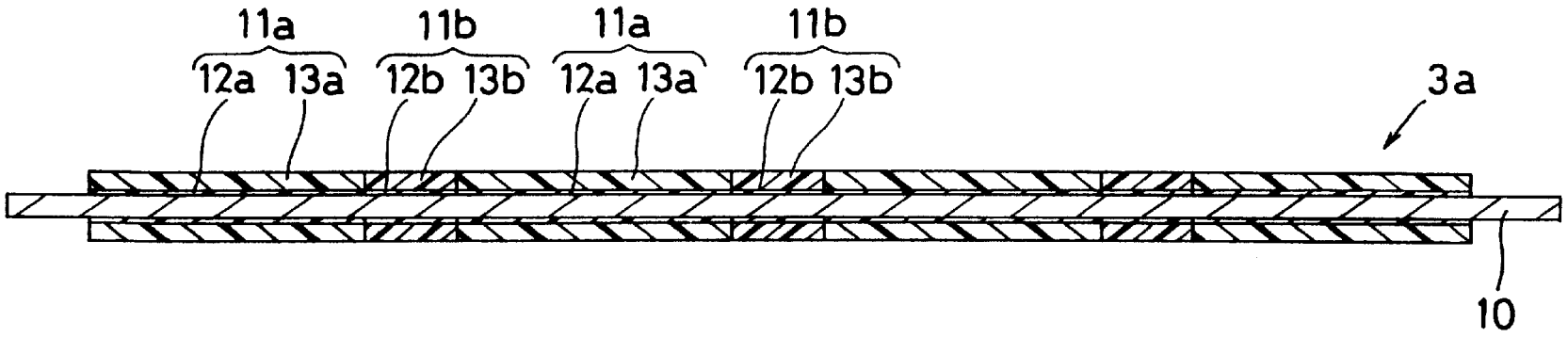
FIG. 5 is a cross sectional view showing a toner supplying roller 3*a;*

Hereinafter, the toner supplying roller 3 having a relatively simple structure will be described in detail. FIG. 5 is a cross-sectional view showing a toner supplying roller 3*a*. In the toner supplying roller 3*a*, elastic bodies 13*a* and 13*b* of composite members 11*a* and 11*b* are formed of different cellular materials such as sponge, having different cell densities. For instance, the composite member 11*a*, which has a hollow body 12*a* and an elastic body 13*a* having a cell density $\alpha$, is used for fresh toner, while the composite member 11*b*, which has a hollow body 12*b* and an elastic body 13*b* having a cell density $\beta$ ($\beta$ is not equal to $\alpha$), is used for collected toner. For example, the composite members 11*a* and composite members 11*b* are arranged in alternating relation at predetermined positions. For example, the cell density $\alpha$ is selected to be 50 cells per inch, while the cell density $\beta$ is selected to be 10 cells per inch.

Such arrangement makes it possible to realize and dispose the single toner supplying roller 3*a* having the elastic bodies 13*a* and 13*b* suitable for fresh toner and for collected toner, respectively. Meanwhile, fresh toner stored in the housing part 6 is discharged from a portion of the elastic body 13*a* suitable for fresh toner, while collected toner stored in the housing part 7 is discharged from a portion of the elastic body 13*b* suitable for collected toner. Therefore, it becomes possible to supply an optimal mixture of collected toner and fresh toner to the developing section 18.

Figure 6:
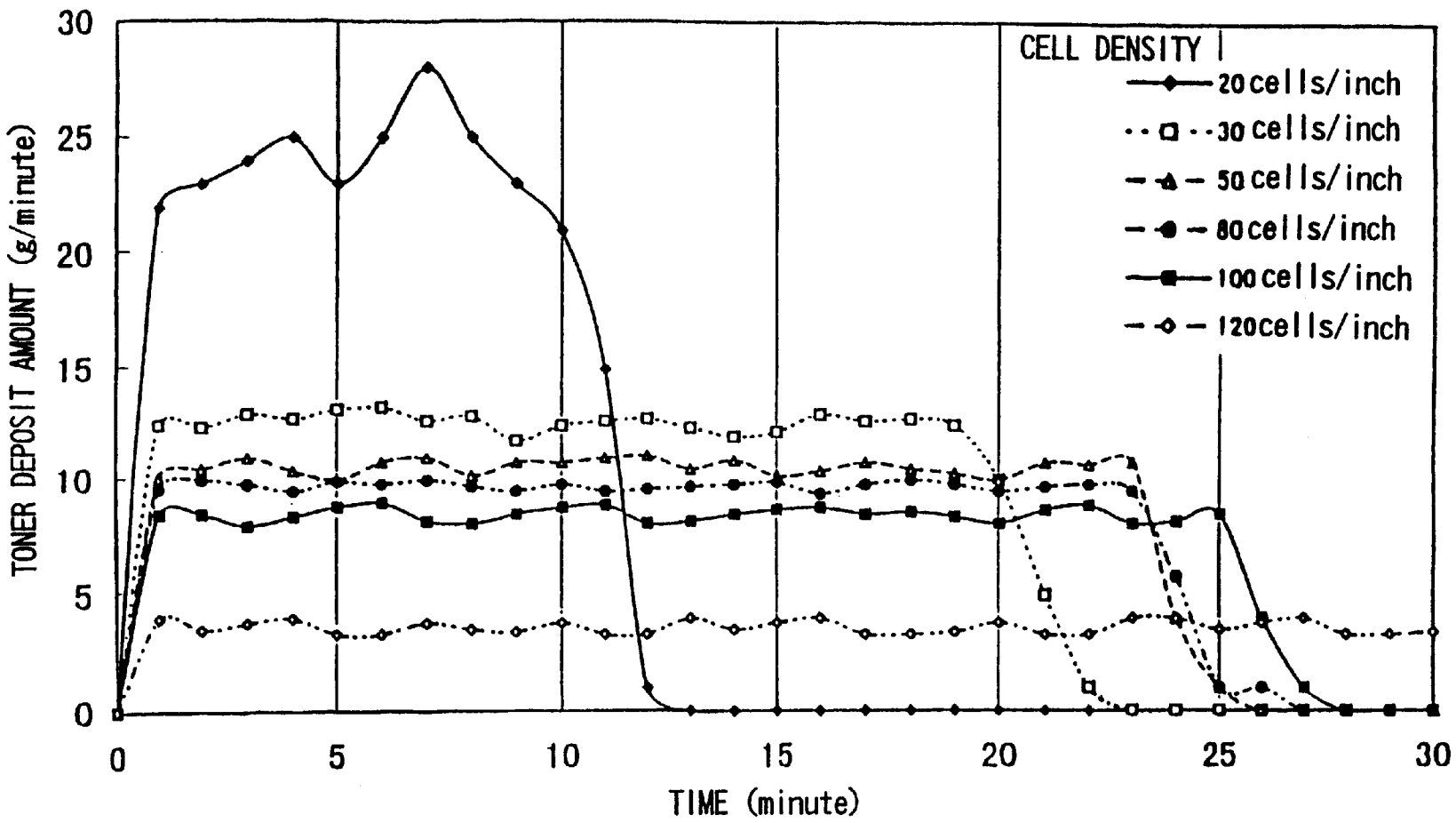
FIG. 6 is a graph showing a relationship between the time (minute) and the toner deposit amount (g/minute) for each cell density with respect to fresh toner.
Figure 7:
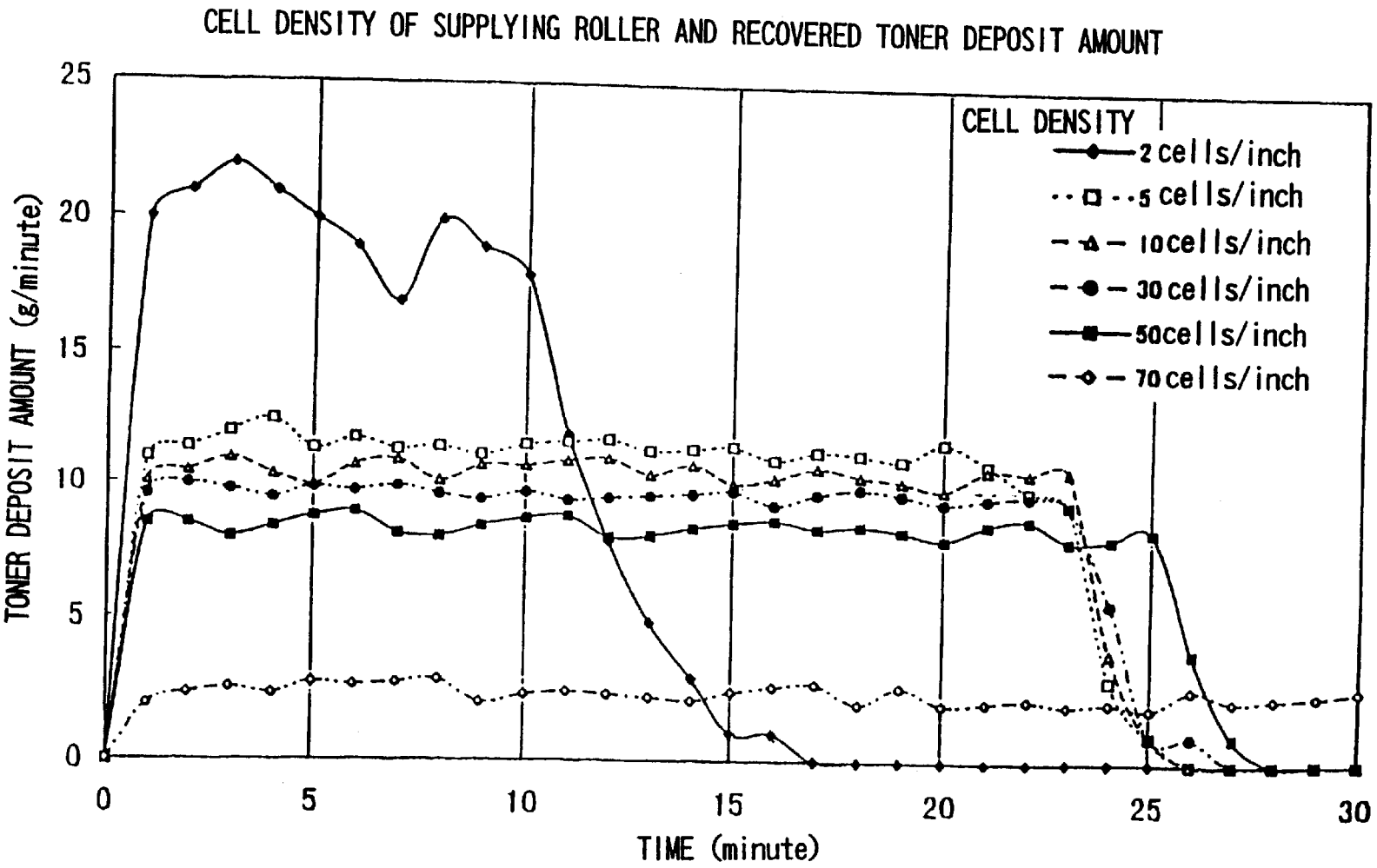
FIG. 7 is a graph showing a relationship between the time (minute) and the toner deposit amount (g/minute) for each cell density with respect to collected toner.

FIGS. 6 and 7 are graphs showing relationships between the time (minute) and the toner deposit amount (g/minute)

for each cell density. FIG. 6 shows results for fresh toner and FIG. 7 shows results for collected toner.

As can be seen from FIG. 6, it is desirable to select a cell density falling in the range from 30 to 100 cells per inch, preferably a cell density falling in the range from 50 to 80 cells per inch in the elastic body 13*a* for fresh toner. On the other hand, as can be seen from FIG. 7, it is desirable to select a cell density falling in the range from 5 to 50 cells per inch, preferably a cell density falling in the range from 10 to 30 cells per inch in the elastic body 13*b* for collected toner.

For the elastic body 13*a* for fresh toner, it is desirable to select a cell size from 30 to 100 times the toner volume mean particle diameter, preferably a cell size from 40 to 65 times the toner volume mean particle diameter. Further, it is desirable to select a cell size from 45 to 150 times the toner count mean particle diameter, preferably from 60 to 90 times the toner number mean particle diameter.

By the cell density (the number of cells) is meant the number of linearly-arranged cells per unit length (25.4 mm). The cell size is a value as a result of dividing the unit length by the number of cells, which means length per cell. In the case of fresh toner, its toner particle size is relatively uniform, which makes it possible to employ, as a typical characteristic representing a toner particle diameter, the volume means particle diameter and the number mean particle diameter. On the other hand, in the case of collected toner, it contains there in coagulated toner and impurities. Therefore, it is irrational to represent a toner particle diameter by the foregoing characteristic and it is difficult to numerically specify the particle diameter of collected toner.

FIGS. 8A, 8B, 9, 10A, and 10B are cross-sectional views showing composite members 11*c*–11*m* of the toner supplying roller 3. At edges of hollow bodies 12*c*–12*m* of the composite members 11*c*–11*m* are formed engaging portions for linking together different ones of the hollow bodies 12*c*–12*m*.

Figure 8A:
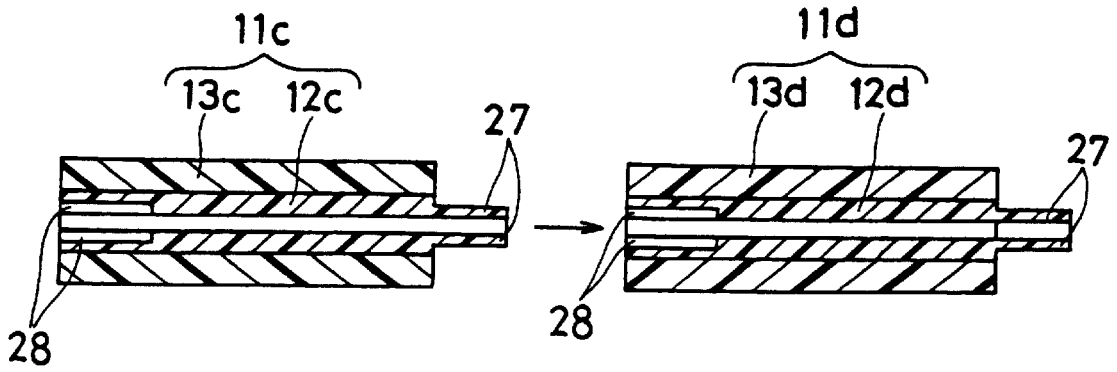
FIGS. 8A and 8B are cross-sectional views showing composite members 11*c*–11*f* of the toner supplying roller 3.

The composite member 11*c*, shown in FIG. 8A, comprises a hollow body 12*c* and an elastic body 13*c*. At one of edges of the hollow body 12*c* is formed a single, ring-like convex portion 27. On the other hand, at the other edge of the hollow body 12*c* is formed a single, ring-like concave portion 28. More specifically, the convex portion 27 is formed so as to project from one end surface of the hollow body 12*c* in the rotary shaft direction. On the other hand, the concave portion 28 is formed so as to indent from the other end surface of the hollow body 12*c*. The composite member 11*d*,is constructed in the same way that the composite member 11*c* is constructed. The composite member 11*d* comprises a hollow body 12*d* and an elastic body 13*d*. At one of edges of the hollow body 12*d* is formed a single convex portion 27. At the other edge of the hollow body 12*d* is fomed a single concave portion 28. The convex portion 27 of the composite member 11*c* is placed into the concave portion 28 of the composite member 11*d* for establishing engagement therebetween, whereby the hollow body 12*c* and the hollow body 12*d* are linked together.

Figure 8B:
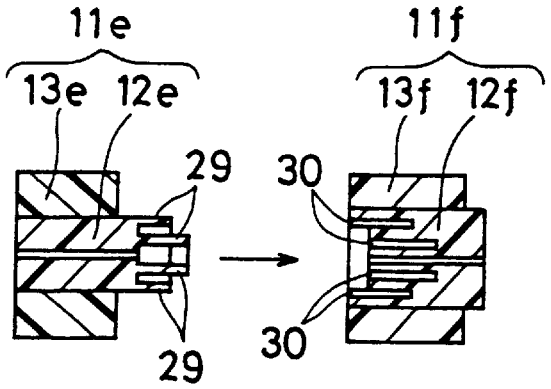

Further, the composite member lie, shown in FIG. 8B, comprises a hollow body 12*e* and an elastic body 13*e*. At one of edges of the hollow body 12*e* are formed a plurality of ring-like convex portions 29 (the number of ring-like convex portions 29 is two in the present embodiment) having different diameters. Each of the convex portions 29 is formed in the same way that the foregoing convex portion 27 is formed. The composite member 11*f* comprises a hollow body 12*f* and an elastic body 13*f*. At one of edges of the hollow body 12*f* are formed a plurality of ring-like concave portions 30 (the number of ring-like concave portions 30 is two in the present embodiment) having different diameters. Each of the concave portions 30 is formed in the same way that the foregoing concave portion 28 is formed. The convex portions 29 of the composite member 11*e* are placed into their corresponding concave portions 30 of the composite member 11*f* for establishing engagement therebetween, whereby the hollow body 12*e* and the hollow body 12*f* are linked together.

Figure 9:
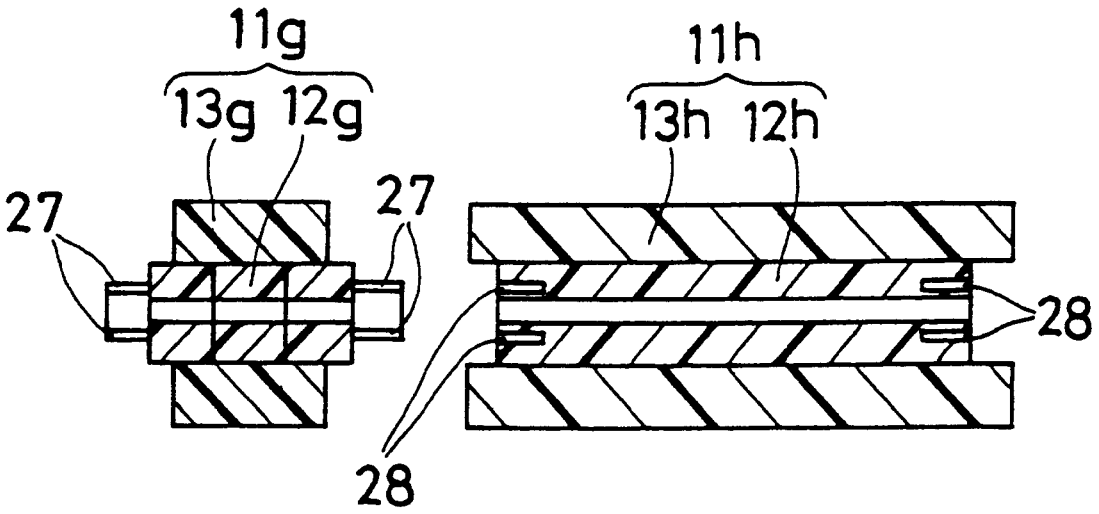
FIG. 9 is a cross-sectional view showing composite members 11*g* and 11*h* of the toner supplying roller 3.

Further, the composite member 11*g*, shown in FIG. 9, comprises a hollow body 12*g* and an elastic body 13*g*. At both edges of the hollow body 12*g* are formed convex portions 27. The composite member 11*h* comprises a hollow body 12*h* and an elastic body 13*h*. At both edges of the hollow body 12*h* are formed concave portions 28. One of the convex portions 27 of the composite member 11*g* is placed into a corresponding one of the concave portions 28 of the composite member 11*h* for establishing engagement therebetween, whereby the hollow body 12*g* and the hollow body 12*h* are linked together. For example, the composite member 11*g* is used for collected toner and the composite member 11*h* is used for fresh toner, which makes it easy to distinguish between members at the time of assembly because the shape differs from toner to toner.

Figure 10A:
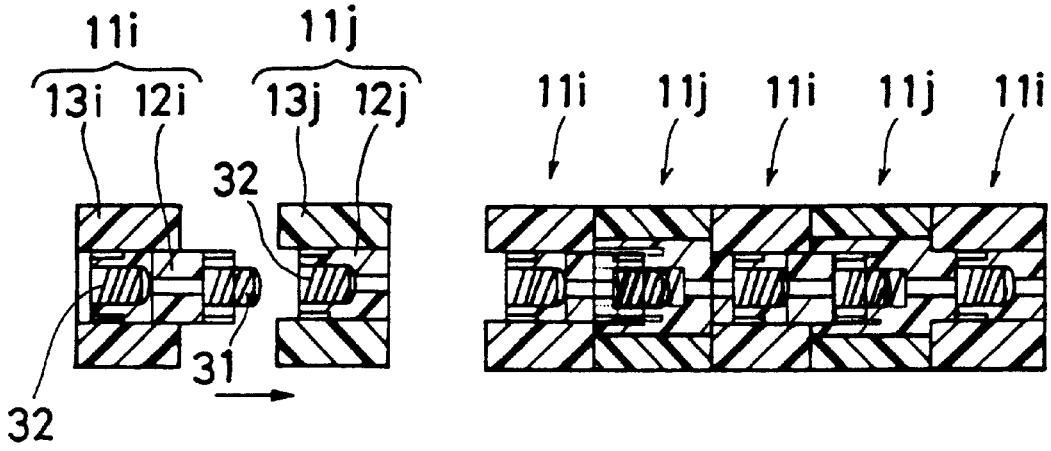
FIGS. 10A and 10B are cross-sectional views showing composite members 11*i*–11*m* of the toner supplying roller 3.

Further, the composite member 11*i*, shown in FIG. 10A, comprises a hollow body 12*i* and an elastic body 13*i*. At one of edges of the hollow body 12*i* is formed an external thread portion 31. At the other edge of the hollow body 12*i* is formed an internal thread portion 32. More specifically, the external thread portion 31 is formed so as to project from one of end surfaces of the hollow body 12*i* in the rotary shaft direction and the internal thread portion 32 is formed so as to indent from the other end surface of the hollow body 12*i* in the rotary shaft direction. The composite member 11*j* comprises a hollow body 12*j* and an elastic body 13*j*. At one of edges of the hollow body 12*j* is formed an internal thread portion 32. More specifically, the internal thread portion 32 is formed so as to indent from one end surface of the hollow body 12*j* in the rotary shaft direction. The external thread portion 31 of the composite member 11*i* is screwed into the internal thread portion 32 of the composite member 11*j* for establishing engagement therebetween, whereby the hollow body 12*i* and the hollow body 12*j* are linked together.

Figure 10B:
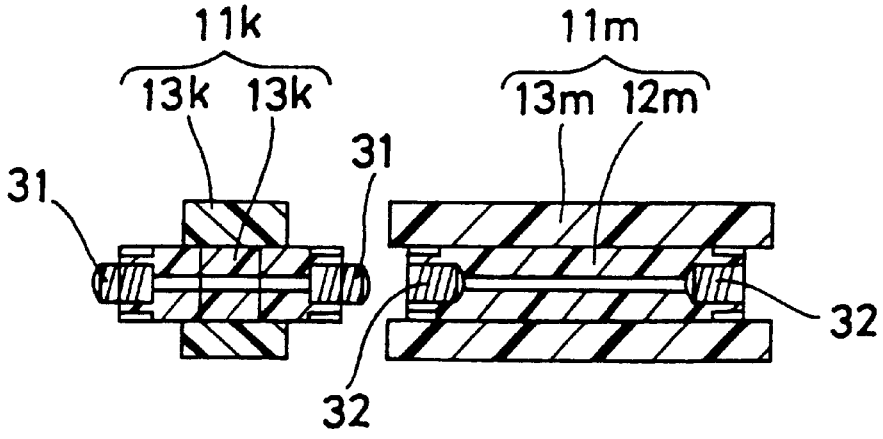

Further, the composite member 11*k*, shown in FIG. 10B, comprises a hollow body 12*k* and an elastic body 13*k*. At both edges of the hollow body 12*k* are formed external thread portions 31. The composite member 11m comprises a hollow body 12*m* and an elastic body 13*m*. At both edges of the hollow body 12*m* are formed internal thread portions 32. One of the external thread portions 31 of the composite member 11*k* is screwed into a corresponding one of the internal thread portions 32 of the composite member 11*m* for establishing engagement therebetween, whereby the hollow body 12*k* and the hollow body 12*m* are linked together. For example, the composite member 11*k* is used for collected toner and the composite member 11*m* is used for fresh toner, which makes it easy to distinguish between members at the time of assembly because the shape differs from toner to toner.

As described above, adjoining hollow bodies 12*c*–12*m* are linked together by an engaging part composed of the convex portion 27 and the concave portion 28, by an engaging part composed of the convex portion 29 and the concave portion 30, or by an engaging part composed of then external thread portion 31 and then internal thread portion 32. Accordingly, the drive of the rotary shaft 10 can be transmitted to all the hollow bodies 12*c*–12*m*.

Particularly, the hollow body 12*i* and the hollow body 12*j* or the hollow body 12*k* and the hollow body 12*m* can firmly be linked together by thread-like engaging parts, which ensures that the drive of the rotary shaft 10 is transmitted to all the hollow bodies 12*i*–12*m*.

Each of the above-described engaging parts is formed along the rotary shaft direction of the hollow bodies 12*c*–12*m* without exerting any influence on the form of the elastic bodies 13*c*–13*m*. Accordingly, each of the elastic bodies 13*c*–13*m* can be formed easily to the same shape without taking into account the form of the hollow bodies 12*c*–12*m*.

Figures 11A, 11B:
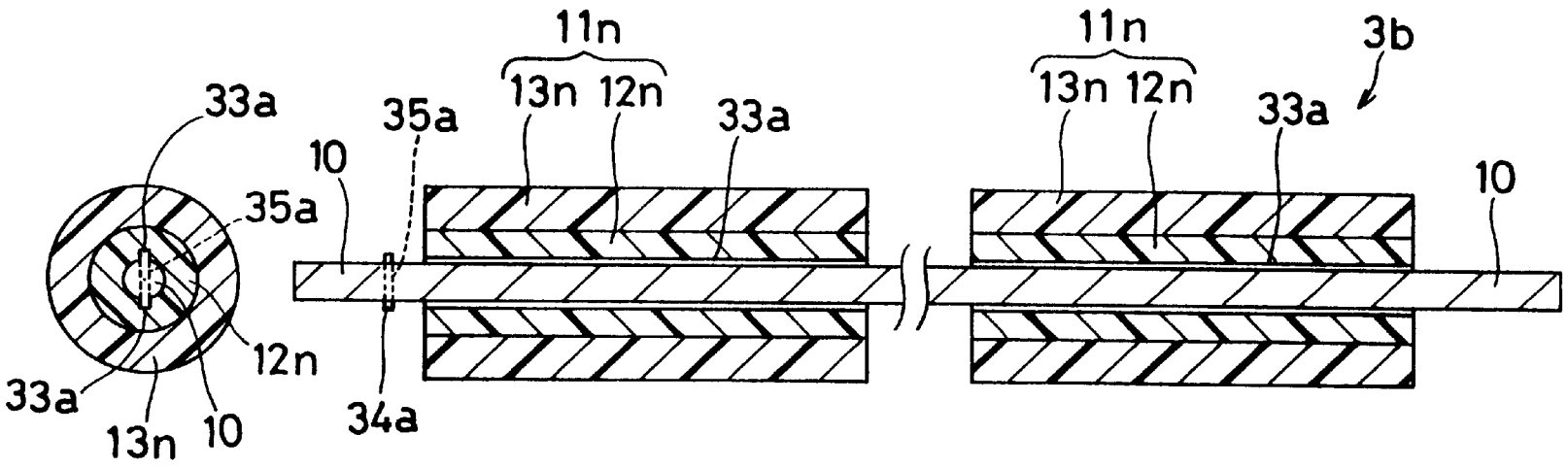
Figures 12A, 12B:
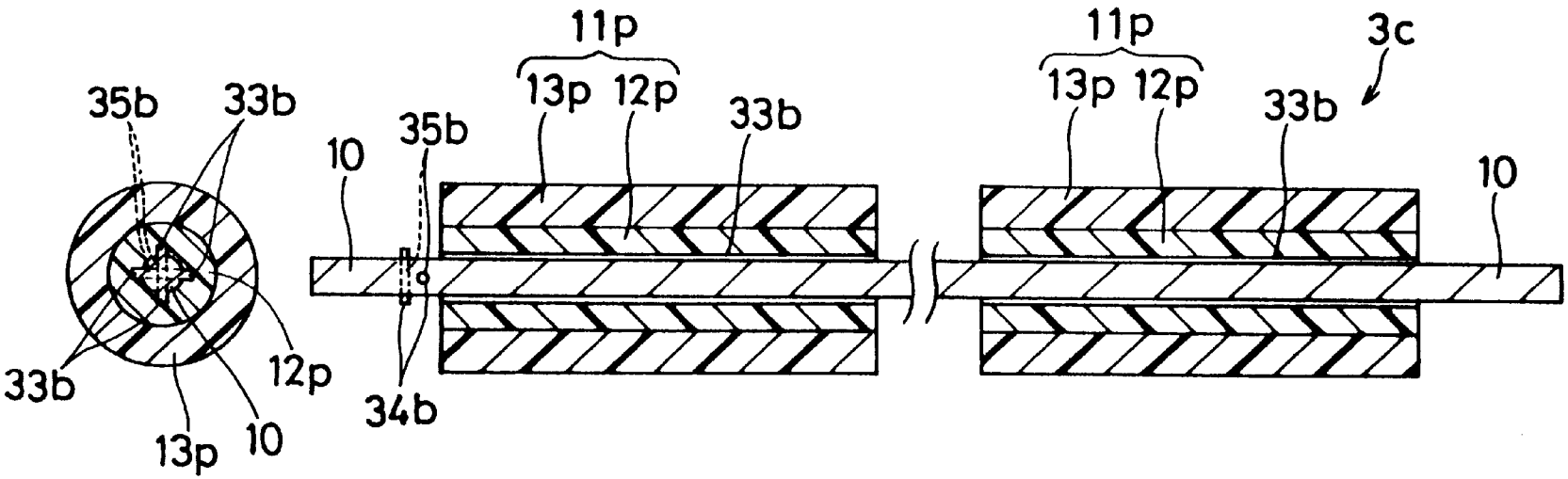
Figure 13A:
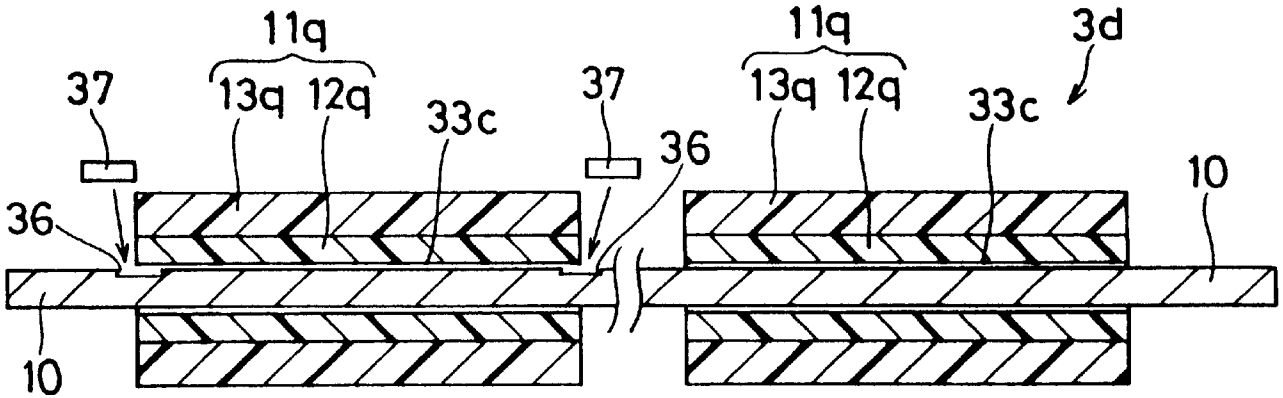
Figure 13B:
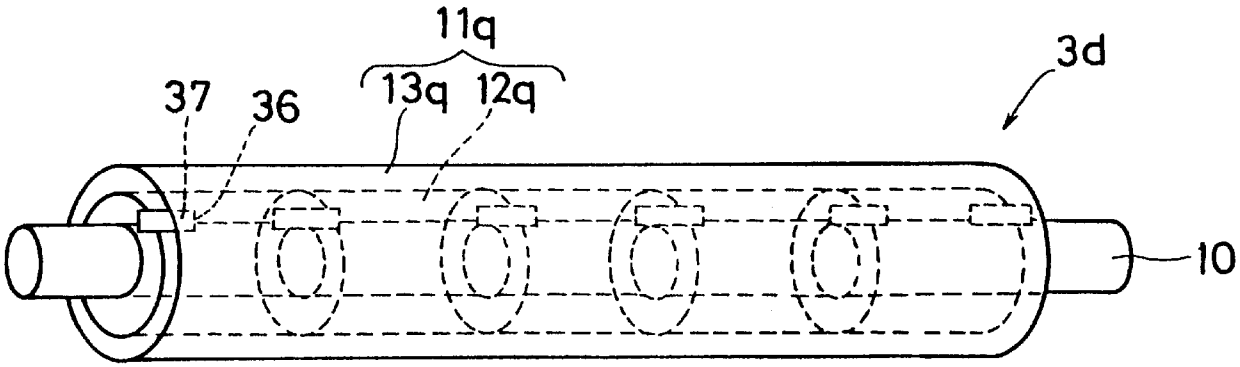

FIGS. 11A, 11B, 12A, 12B, 13A and 13B are diagrams showing toner supplying rollers 3*b*–3*d*. FIGS. 11A and 12A are cross-sectional views taken in the direction perpendicular to the rotary shaft 10. FIGS. 11B, 12B and 13A are cross-sectional views taken in the direction in parallel with the rotary shaft 10. FIG. 13B is a perspective view of the toner supplying roller 3*d*. The rotary shaft 10 and hollow bodies 12*n*, 12*p*, and 12*q* which are fit into the rotary shaft 10 are provided with slip-preventing members for preventing the hollow bodies 12*n*, 12*p*, and 12*q* from slipping.

The toner supplying roller 3*b*, shown in FIGS. 11A and 11B, includes a single rotary shaft 10 and a plurality of composite members 11*n*. A pin hole 35*a*, through which a pin member 34*a* is inserted, is formed in the rotary shaft 10, passing through the rotary shaft 10 in a direction normal to the rotational shaft direction. The length of the pin member 34*a* is chosen to be longer than the diameter of the rotary shaft 10, so that both edges of the pin member 34*a* project from the rotary shaft 10 at the time of insertion. Each of the composite members 11*n* comprises a hollow body 12*n* and an elastic body 13*n*. A pair of groove portions 33*a* are formed to confront each other in the internal wall of the hollow body 12*n* along the rotary shaft direction. The depth of the groove portions 33*a* is chosen to be approximately equal to the projecting length of the edges of the pin member 34*a* at the time of insertion. The groove portions 33*a* engage with the projecting portions of the pin member 34*a* inserted into the pin hole 35*a* of the rotary shaft 10.

The toner supplying roller 3*c*, shown in FIGS. 12A and 12B, includes the single rotary shaft 10 and a plurality of composite members 11*p*. Pin holes 35*b*, through which a plurality of pin members 34*b* (the number of which is two in the present embodiment) are inserted, are formed in the rotary shaft 10, passing through the rotary shaft 10 in a direction normal to the rotational shaft direction. The length of the pin members 34*b* is chosen to be longer than the diameter of the rotary shaft 10, so that both edges of each of the pin members 34*b* project from the rotary shaft 10 at the time of insertion. Each of the composite members lip comprises the hollow body 12*p* and an elastic body 13*p*. Plural pairs of groove portions 33*b* (two pairs in the present embodiment) are formed to confront each other in the internal wall of the hollow body 12*p* along the rotary shaft direction. The groove portions 33*b* engage with the projecting portions of the pin members 34*b* inserted into the pin holes 35*b* of the rotary shaft 10.

The toner supplying roller 3*d*, shown in FIGS. 13A and 13B, includes the single rotary shaft 10 and a plurality of composite members 11*q*. Concave portions 36, with which a plurality of supporting pieces 37 engage, are formed in parallel with the rotary shaft direction in the rotary shaft 10. The thickness of the supporting pieces 37 is selected such that each supporting piece 37 projects from the rotary shaft 10 when engaged with the rotary shaft 10. Each of the composite members 11*q* comprises the hollow body 12*q* and the elastic body 13*q*, and groove portions 33*c* are formed to confront each other in the internal wall of the hollow body 12*q* along the rotary shaft direction. The groove portions 33*c* are engaged with the projecting portions of the supporting pieces 37 engaged with the concave portions 36 of the rotary shaft 10.

As a result of such arrangement, it is possible to prevent the hollow bodies 12*n*–12*q* from slipping over the rotary shaft 10 and to reliably ensure the drive transmission of the rotary shaft 10.

Figure 14:
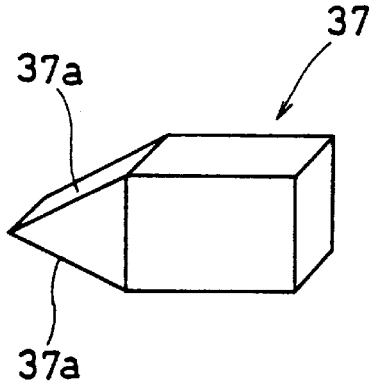
FIG. 14 is a perspective view showing a supporting piece having a tapered member 37*a;*

Referring to FIGS. 11A, 11B, 12A, and 12B, the groove portions 33*a* and 33*b* defined in the hollow bodies 12*n* and 12*p*, the pin members 34*a* and 34*b*, and the pin holes 35*a* and 35*b* defined in the rotary shaft 10 together form slip-preventing members. Further, referring to FIGS. 13A and 13B, the groove portions 33*c* defined in. the hollow body 12*q*, the concave portions 36 defined in the rotary shaft 10, and the supporting pieces 37 together form slip-preventing members. A structure may be employed in which a tapered portion 37*a* is formed in the supporting piece 37 as shown in FIG. 14 so as to provide easy engagement between the supporting piece 37 and the groove portion 33*c* of the hollow body 12*q*.

It is preferred that end surfaces of the elastic bodies 13 of adjoining composite members 11 are adhered together. This prevents the edges of the elastic body 13 from deteriorating by rotational stress.

Figure 15:
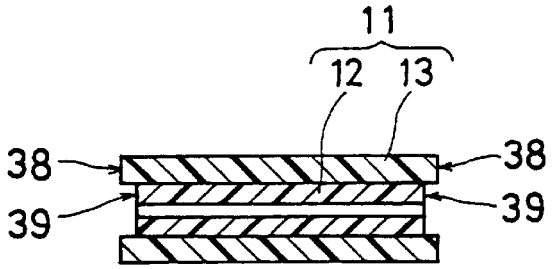
FIG. 15 is a cross-sectional view showing a composite member 11.

Further, as shown in FIG. 15, it is preferred that an end surface 38 of the elastic body 13 of each of the composite members 11 projects beyond an end surface 39 of the hollow body 12. For example, the end surface 38 projects beyond the end surface 39 by about 1 mm to about 2 mm. As a result of such arrangement, when a plurality of composite members 11 are fit into the rotary shaft 10, projecting end surfaces 38 of the elastic bodies 13 are brought into close contact with one another. This accordingly prevents the occurrence of a difference in level due to a gap and expansion between adjoining elastic bodies 13 and expansion, thereby preventing the leakage of supplied toner and the deterioration of the toner supplying roller 3.

Figure 16:
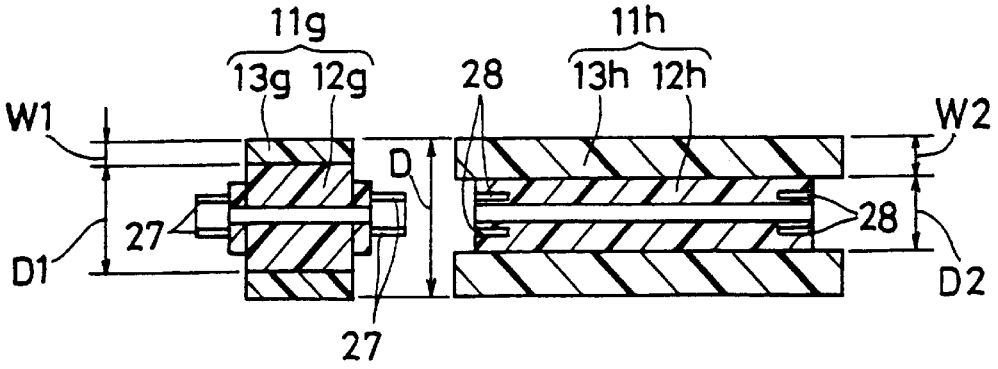
FIG. 16 is a cross-sectional view showing composite members 11*g* and 11*h;*

Further, as shown in FIG. 16, it is preferred that the hollow bodies 12*g* and 12*h* of the composite members 11*g* and 11*h* next to each other have different external diameters D1 and D2. For example, the external diameter D1 of the hollow body 12*g* of the composite member 11*g* for collected toner is set to a larger value than the external diameter D2 of the hollow body 12*h* of the composite member 11*h* for fresh toner. In order that the composite members 11*g* and 11*h* have the same external diameter D, a thickness w1 and a thickness w2 are selected for the elastic body 13*g* and the elastic body 13*h*, respectively. Because of such arrangement, at the time of assembling the toner supplying roller 3, it becomes possible to easily distinguish between members thereby providing improvements in the workability.

Additionally, it is preferred that the elastic body 13 for fresh toner and the elastic body 13 for collected toner differ in color tone from each other. This also makes it possible to easily distinguish between members when assembling the toner supplying roller 3. For example, these elastic bodies may differ in shading from each other.

The scope of the present invention covers not only the developing unit 17 having the above-described toner supplying roller 3 but also the image forming apparatus 14 having the developing unit 17.

Figure 17:
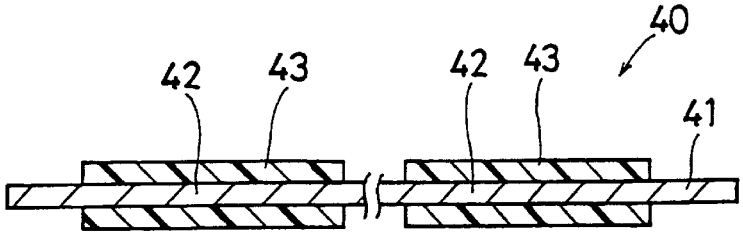
FIG. 17 is a cross-sectional view showing a toner supplying roller 40 for a developing unit as a second embodiment of the present invention.

FIG. 17 is a cross-sectional view showing a toner supplying roller 40 mounted in a developing unit as a second embodiment of the present invention. In the developing unit of the second embodiment, its structure is the same as that of the first embodiment except for the toner supplying roller 40. The toner supplying roller 40 comprises a plurality of rotary shaft members 42 which are linked together to form a rotary shaft 41 and cylindrical elastic members 43 which are fit to outer peripheral surfaces of the rotary shaft members 42, respectively.

Material used to form the rotary shaft member 42 is selected in the same way as the rotary shaft 10. Further, material used to form the elastic member 43 and its elastic modulus are selected in the same way as the elastic body 13.

The rotary shaft members 42 are linked together for the formation of the rotary shaft 41 the entire length of which exceeds more than 300 mm. Therefore, it is preferred that each of the rotary shaft members 42 is made of metal in order to provide the toner supplying roller 40 with sufficient rigidity and to make it possible to supply uniform amounts of toner.

Also in the present embodiment, the toner supplying roller 40 is provided in common to collected toner and fresh toner. Collected toner and fresh toner are mixed with each other. The toner mix is fed to the developing section 18. Accordingly, the toner supplying roller 40 in the developing unit or in the image forming apparatus is provided with simplified drive and control mechanisms. The toner supplying roller 40 is constructed relatively easily without using the foregoing rotary shaft, therefore providing reductions in the manufacturing cost of developing units or image forming apparatus.

In the toner supplying roller 40, like the elastic body 13, the elastic members 43 are composed of different cellular materials such as sponge, having different cell densities. Such arrangement makes it possible to realize and dispose the single toner supplying roller 40 having the elastic members 43 suitable for fresh toner and collected toner, respectively. Meanwhile, fresh toner stored in the housing part 6 is discharged from a portion of the elasticmember 43 suitable for fresh toner, while collected toner stored in the housing part 7 is discharged from a portion of the elastic member 43 suitable for collected toner. Therefore, it becomes possible to supply an optimal mixture of collected toner and fresh toner to the developing section 18.

Hereinafter, the toner supplying roller 40 with a relatively simple structure will be described in detail. FIGS. 18A, 18B, 19A and 19B are cross-sectional views showing toner supplying rollers 40*a*–40*d*. At edges of rotary shaft members of the toner supplying rollers 40*a*–40*d* are formed linking portions for establishing linkage between different types of the rotary shaft members.

Figure 18A:
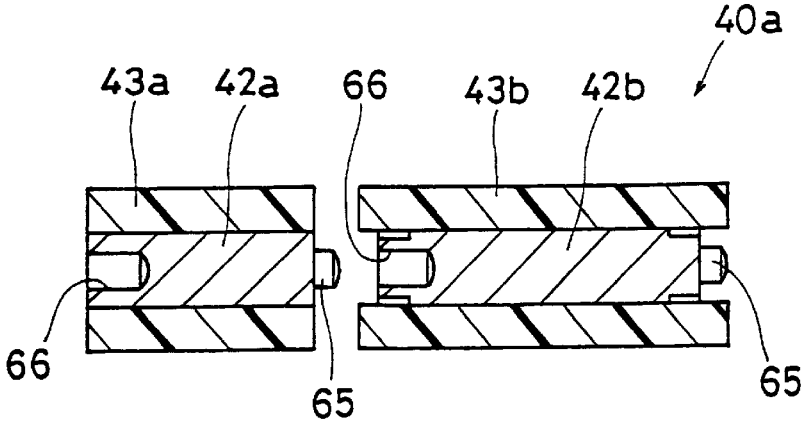
FIGS. 18A and 18B are cross-sectional views showing toner supplying rollers 40*a* and 40*b;*

The toner supplying roller 40*a*, shown in FIG. 18A, includes a rotary shaft member 42*a* with an elastic member 43*a* fit thereinto and a rotary shaft member 42*b* with an elastic member 43*b* fit thereinto. At one of edges of the rotary shaft member 42*a* is formed a single convex portion 65. At the other edge of the rotary shaft member 42*a* is formed a single concave portion 66. More specifically, the convex portion 65 is formed so as to project from one of end surfaces of the rotary shaft member 42*a* in the rotary shaft direction, while the concave portion 66 is formed so as to indent from the other end surface of the rotary shaft member 42*a*. Likewise, a single convex portion 65 is formed at one of edges of the rotary shaft member 42*b* and a single concave portion 66 is formed at the other edge. The convex portion 65 of the rotary shaft member 42*a* and the concave portion 66 of the rotary shaft member 42*b* are engaged with each other, whereby the rotary shaft members 42*a* and 42*b* can be linked together.

Figure 18B:
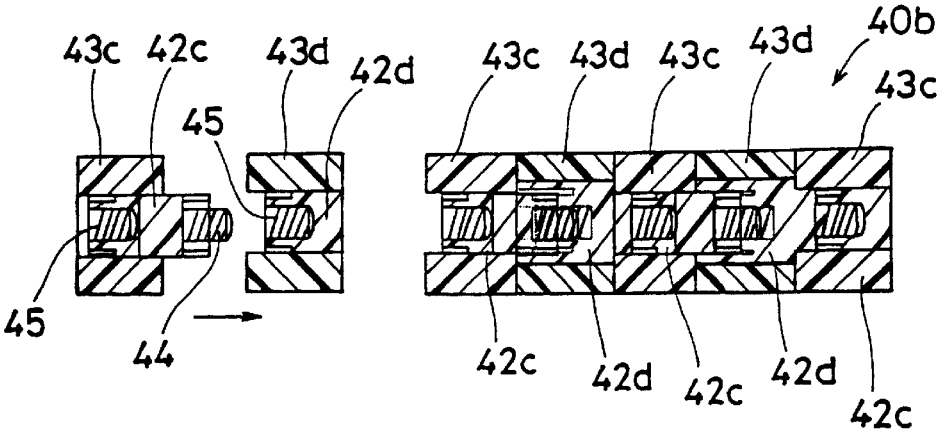

Further, the toner supplying roller 40*b*, shown in FIG. 18B, includes a rotary shaft member 42*c* with an elastic member 43*c* fit thereinto and a rotary shaft member 42*d* with an elastic member 43*d* fit thereinto. At one of edges of the rotary shaft member 42*c* is formed an external thread portion 44. At the other edge of the rotary shaft member 42*c* is formed an internal thread portion 45. An internal thread portion 45 is formed at one of edges of the rotary shaft member 42*d*. More specifically, the external thread portion 44 and the internal thread portion 45 project from end surfaces of the rotary shaft members 42*c* and 42*d* in the rotary shaft direction. The external thread portion 44 of the rotary shaft member 42*c* is screwed into the internal thread portion 45 of the rotary shaft member 42*d*, thereby linking together the rotary shaft member 42*c* and the rotary shaft member 42*d*.

Figure 19A:
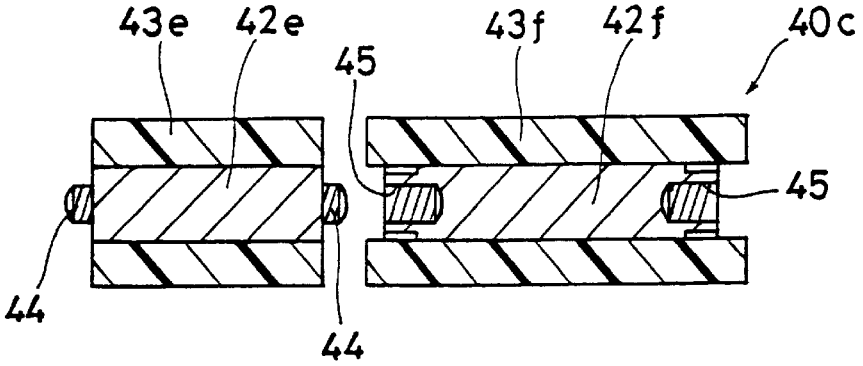
FIGS. 19 and 19B are cross-sectional views showing toner supplying rollers 40*c* and 40*d;*
Figure 19B:
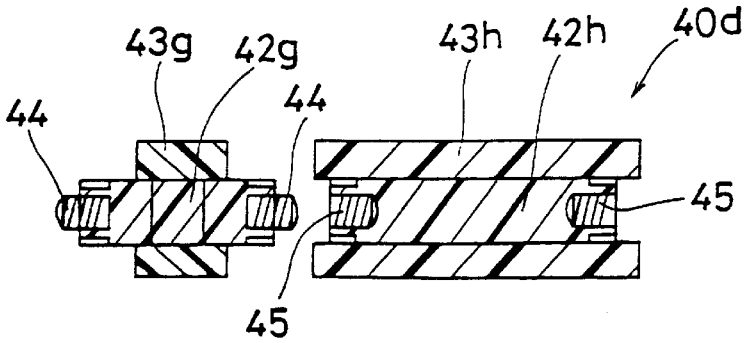

Further, the toner supplying roller 40*c*, shown in FIG. 19A, includes a rotary shaft member 42*e* with an elastic member 43*e* fit thereinto and a rotary shaft member 42*f* with an elastic member 43*f* fit thereinto. At both edges of the rotary shaft member 42*e* are formed external thread portions 44. On the other hand, formed at both edges of the rotary shaft member 42*f* are internal thread portions 45. One of the external thread portions 44 of the rotary shaft member 42*e* is screwed into a corresponding one of the internal thread portions 45 of the rotary shaft member 42*f*, thereby linking together the rotary shaft member 42*e* and the rotary shaft member 42*f*. For example, the elastic member 43*e* of the rotary shaft member 42*e* having the external thread portions 44 is used for collected toner, while the elastic member 43*f* of the rotary shaft member 42*f* having the internal thread portions 45 is used for fresh toner. Since the shape differs from toner to toner, it becomes easy to distinguish between members at the time of assembly. Further, the toner supplying roller 40*d*, shown in FIG. 19B, includes a rotary shaft member 42*g* with an elastic member 43*g* fit thereinto and a rotary shaft member 42*h* with an elastic member 43*h* fit thereinto. At both edges of the rotary shaft member 42*g* are formed external thread portions 44. On the other hand, formed at both edges of the rotary shaft member 42*h* are internal thread portions 45. One of the external thread portions 44 of the rotary shaft member 42*g* is screwed into a corresponding one of the internal thread portions 45 of the rotary shaft member 42*h*, thereby linking together the rotary shaft member 42*g* and the rotary shaft member 42*h*. For example, the elastic member 43*g* of the rotary shaft member 42*g* having the external thread portions 44 is used for collected toner, while the elastic member 43*h* of the rotary shaft member 42*h* having the internal thread portions 45 are used for fresh toner. Since the shape differs from toner to toner, it becomes easy to distinguish between members at the time of assembly.

As described above, adjoining rotary shaft members 42*a*–42*h* are linked together either by a linking part formed by the convex portion 65 and the concave portion 66 or by a linking part formed by the external thread portion 44 and the internal thread portion 45. Accordingly, the drive of the rotary shaft 41 can be transmitted to all the elastic members 43*a*–43*h*. Particularly, the rotary shaft members 42*c*–42*h* are firmly linked together by thread-like linking parts, thereby ensuring that the drive of the rotary shaft 41 is transmitted to all the elastic members 43*c*–43*h*.

Each linking part is formed along the rotary shaft direction of the rotary shaft members 42*a*–42*h*. Accordingly, each of the elastic members 43*a*–43*h* can be formed easily to the same form without taking into account the form of the rotary shaft members 42*a*–42*h*.

Figure 20:
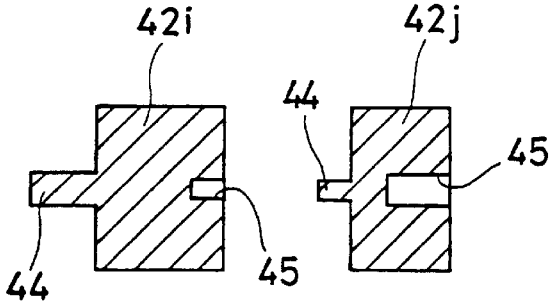
FIG. 20 is a cross-sectional view showing rotary shaft members 42*i* and 42*j* of a toner supplying roller.

FIG. 20 is a cross-sectional view showing rotary shaft members 42*i* and 42*j* of the toner supplying roller. The rotary shaft member 42*i* has an external thread portion 44 and an internal thread portion 45, wherein the external thread portion 44 differs in thread diameter from the internal thread portion 45. Likewise, the rotary shaft member 42*j* has an external thread portion 44 and an internal thread portion 45, wherein the external thread portion 44 differs in thread diameter from the internal thread portion 45. The thread diameter of the external thread portion 44 of the rotary shaft member 42*i* and that of the internal thread portion 45 of the rotary shaft member 42*j* are selected to be equal to each other. The thread diameter of the internal thread portion 45 of the rotary shaft member 42*i* and that of the external thread portion 44 of the rotary shaft member 42*j* are selected to be equal to each other. As a result of such arrangement, only a specific rotary shaft member (i.e., the rotary shaft member 42*j*) is allowed to be screwed into the rotary shaft member 42*i*. This prevents a member from being screwed into a wrong one.

Figure 21:
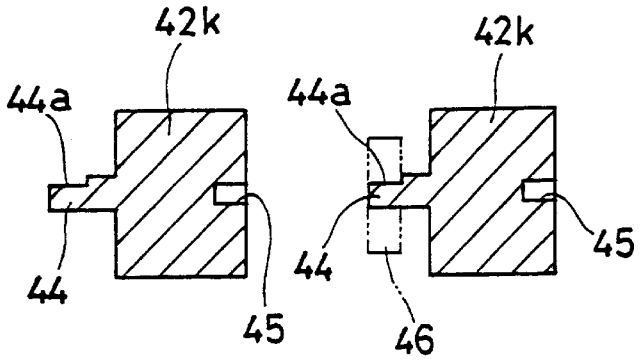
FIG. 21 is a cross-sectional view showing a rotary shaft member 42*k* of a toner supplying roller.

As shown in FIG. 21 which depicts a rotary shaft member 42*k*, it is preferred that a milled surface 44*a*, on which a gear 46 for driving the toner supplying roller is located and clamped, is formed in an external thread portion 44 of the rotary shaft member 42*k* which is screwed into the edgemost section, running parallel with the rotary shaft direction.

It is preferred that end surfaces of adjoining elastic members 43 are adhered together. As a result of such arrangement, it becomes possible to prevent the elastic member 43 from deteriorating at its edges due to rotational stress.

Figure 22:
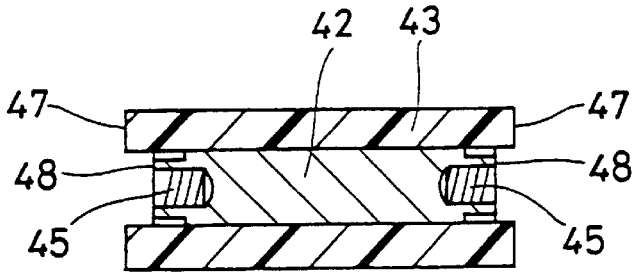
FIG. 22 is a cross-sectional view showing an elastic member 43 and a rotary shaft member 42.

Further, as shown in FIG. 22, it is preferred that an end surface 47 of each of the elastic members 43 projects beyond an end surface 48 of the rotary shaft member 42. For example, the end surface 47 projects beyond the end surface 48 by about plurality of rotary shaft members 42 are linked together, projecting end surfaces 47 of the elastic members 43 are brought into close contact with each other. This accordingly prevents the occurrence of a difference in level due to a gap and expansion between adjoining elastic members 43 and expansion, thereby preventing the leakage of supplied toner and the deterioration of the toner supplying roller 40.

Figure 23:
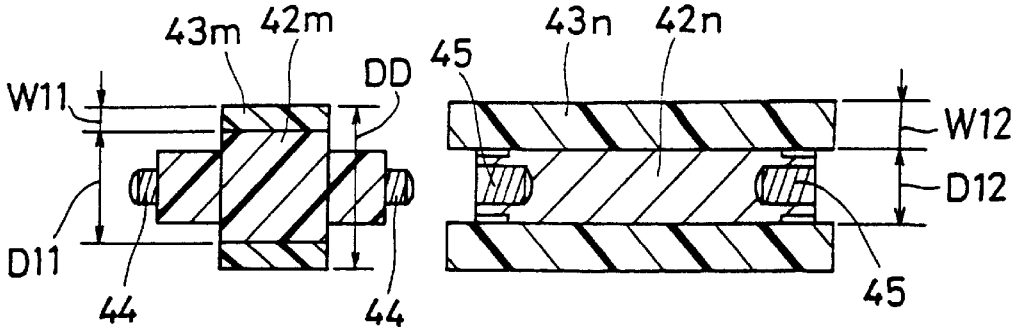
FIG. 23 is a cross-sectional view showing rotary shaft members 42*m* and 42*n;*

Further, as shown in FIG. 23, it is preferred that two rotary shaft members 42*m* and 42*n* next to each other have different external diameters D11 and D12. For example, the external diameter D11 of the rotary shaft member 42*m* for collected toner is set to a larger value than the external diameter D12 of the rotary shaft member 42*n* for fresh toner. Here, in order that the toner supplying roller 40 has a uniform outer diameter DD, a thickness w11 and a thickness w12 are selected for an elastic body 43m and for an elastic body 43*n*, respectively. Because of such arrangement, at the time of assembling the toner supplying roller 40, it becomes possible to easily distinguish between members.

Additionally, it is preferred that the elastic member 43 for fresh toner and the elastic member 43 for collected toner differ in color tone from each other. This makes it possible to easily distinguish between members when assembling the toner supplying roller 40. For example, these elastic members may differ in shading from each other.

Further, the scope of the present invention covers not only a developing unit having the above-described toner supplying roller 40 but also an image forming apparatus having such a developing unit.

Figure 24A:
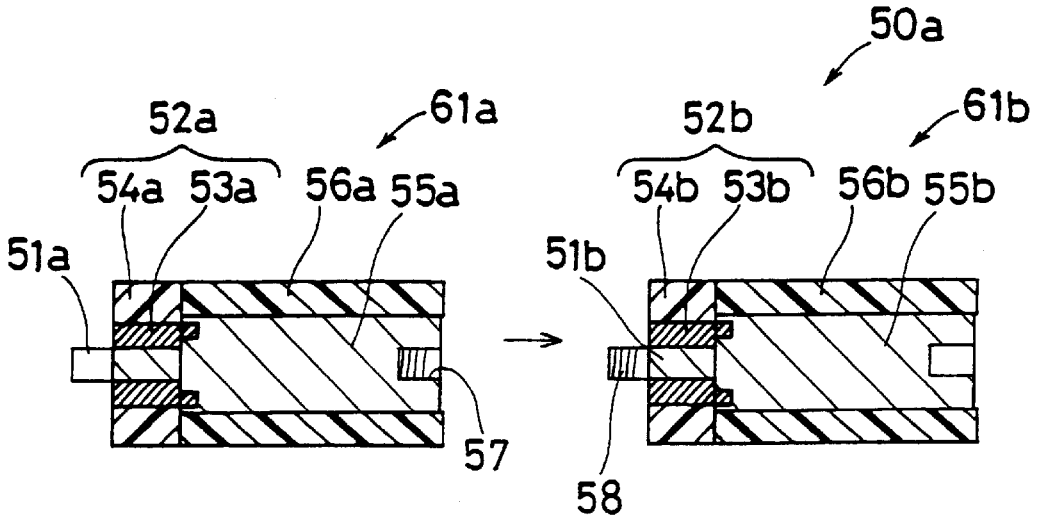
FIG. 24A is a cross-sectional view showing a toner supplying roller 50*a* of a developing unit according to a third embodiment of the present invention.

FIG. 24A is a cross-sectional view showing a toner supplying roller 50*a* mounted in a developing unit as a third embodiment of the present invention. In the developing unit of the third embodiment, its structure is the same as that of the first embodiment except for the toner supplying roller 50*a*. The toner supplying roller 50*a* is a combination of the first and second embodiments.

The toner supplying roller 50*a* has a roller member 61*a* and a roller member 61*b*. The roller member 61*a* has a rotary shaft 51*a*, a cylindrical composite member 52*a* which is fit onto the outerperipheral surface of the rotary shaft 51*a*, aplurality of rotary shaft members 55*a* which are linked together to form a rotary shaft, and an elastic member 56*a* of cylindrical sponge or the like which is fit onto the outer peripheral surface of the rotary shaft member 55*a*. The composite member 52*a* has a hollow body 53*a* and an elastic body 54*a* of sponge or the like material which is fit onto the outer peripheral surface of the hollow body 53*a*.

The roller member 61*b* is constructed in the same manner that the roller member 61*a* is constructed. The roller member 61*b* has a rotary shaft 51*b*, a cylindrical composite member 52*b* which is fit onto the outer peripheral surface of the rotary shaft 51*b*, a plurality of rotary shaft members 55*b* which are linked together to form a rotary shaft, and an cylindrical elastic member 56*b* which is fit onto the outer peripheral surface of the rotary shaft member 55*b*. The composite member 52*b* has a hollow body 53*b* and an elastic body 54*b* which is fit onto the outer peripheral surface of the hollow body 53*b*.

In the rotary shaft member 55*a* of the roller member 61*a* is formed an internal thread portion 57. In the rotary shaft 51*b* of the roller member 61*b* is formed an external thread portion 58. The thread diameter of the external thread portion 58 is selected so as to be equal to the diameter of the rotary shaft 51*b*. The external thread portion 58 is screwed into the internal thread portion 57 to assemble the toner supplying roller 50*a*.

Figure 24B:
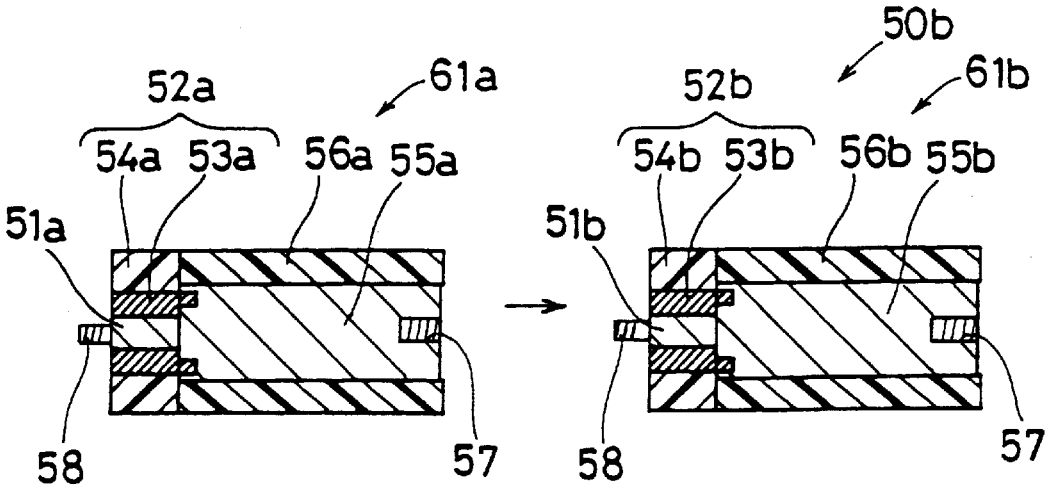
FIG. 24B is a cross-sectional view showing another toner supplying roller 50*b* of the developing unit of the third embodiment.

Referring to FIG. 24B, there is shown a cross section of another toner supplying roller 50*b* mounted in a developing unit as a third embodiment of the present invention. The toner supplying roller 50*b* is constructed in almost the same manner that the foregoing toner supplying roller 50*a* is constructed. In a rotary shaft member 55*a* of a roller member 61*a* is formed an internal thread portion 57. In a rotary shaft 51*b* of the roller member 61*b* is formed an external thread portion 58. The thread diameter of the external thread portion 58 is selected to be smaller than the diameter of the rotary shaft 51*b*. The external thread portion 58 is screwed into the internal thread portion 57 to assemble the toner supplying roller 50*b*.

Figure 25A:
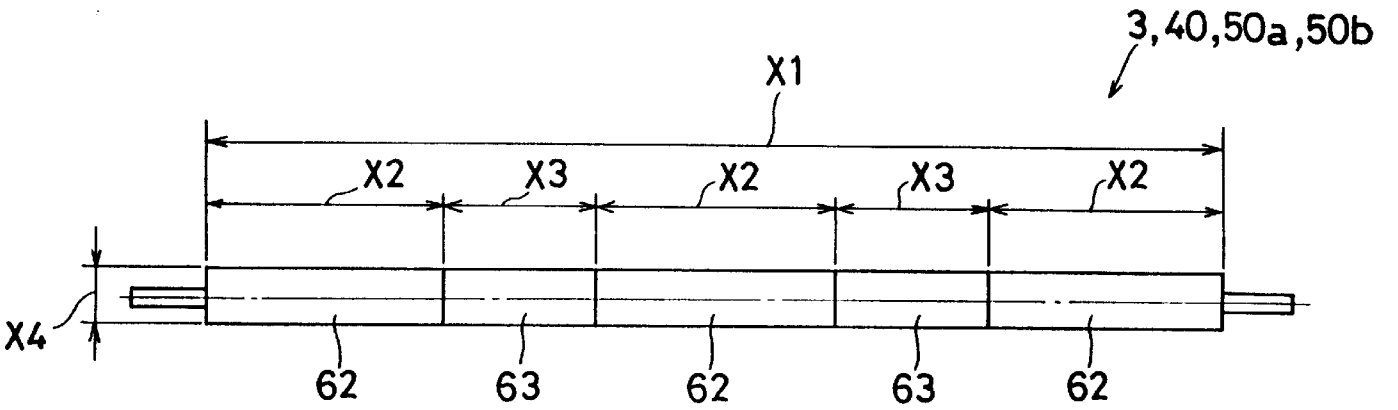
FIGS. 25A and 25B are plan views showing the lengths of the toner supplying rollers 3, 40, 50*a*, and 50*b;*
Figure 25B:
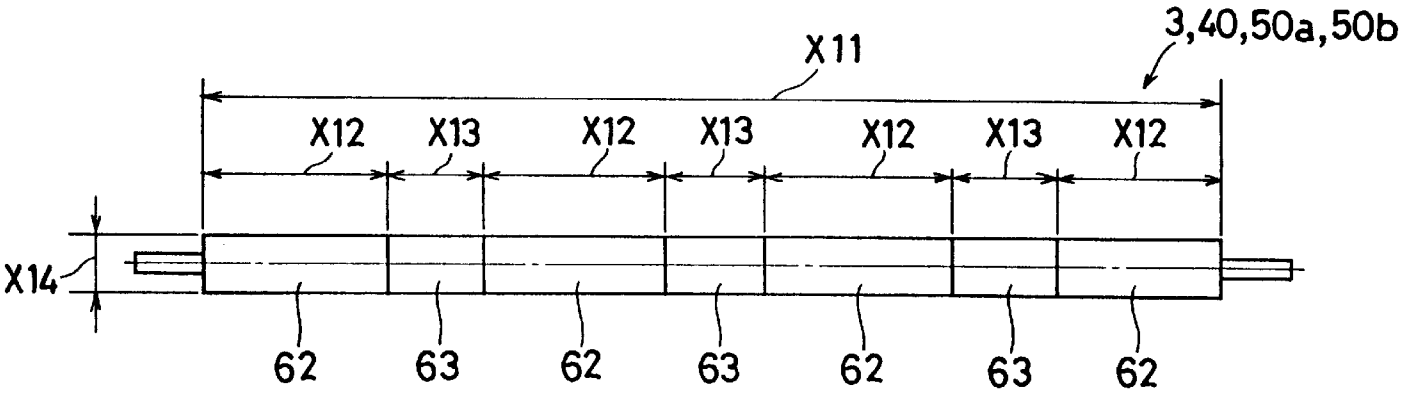

FIGS. 25A and 25B are plan views for the description of the lengths of the toner supplying rollers 3, 40, 50*a*, and 50*b* on the basis of the present invention. As shown in FIG. 25A, a length X1 (which indicates the length of each of the toner supplying rollers 3, 40, 50*a*, and 50*b* in parallel with the rotary shaft direction), a length X2 (which indicated the length of a fresh-toner supplying region 62 in parallel with the rotary shaft direction of each of the toner supplying rollers 3, 40, 50*a*, and 50*b*), a length X3 (which indicates the length of a collected-toner supplying region 63 in parallel with the rotary shaft direction of each of the toner supplying rollers 3, 40, 50*a*, and 50*b*, and a diameter X4 (which indicates the diameter of each of the toner supplying rollers 3, 40, 50*a*, and 50*b*) are selected to be 280 mm, 65.3 mm, 42 mm, and 16 mm, respectively.

As shown in FIG. 25B, a length X1 (which indicates the length of each of the toner supplying rollers 3, 40, 50*a*, and

50*b* in parallel with the rotary shaft direction), a length X12 (which indicates the length of the fresh-toner supplying region 62 in parallel with the rotary shaft direction of each of the toner supplying rollers 3, 40, 50*a*, and 50*b*), a length X13 (which indicates the length of the collected-toner region 63 in parallel with the rotary shaft direction of each of the toner supplying rollers 3, 40, 50*a*, and 50*b*), and a diameter X14 (which indicates the diameter of each of the toner supplying rollers 3, 40, 50*a*, and 50*b*) are selected to be 280 mm, 49 mm, 28 mm, and 16 mm, respectively.

Finally, the result of evaluation of the durability of image forming apparatus according to the present invention containing therein developing units having the foregoing toner supplying rollers 3, 40, 50*a*, and 50*b* will be described. These image forming apparatuses are implemented by electrophotographic copier, laser printer, or facsimile apparatus.

Figure 26:
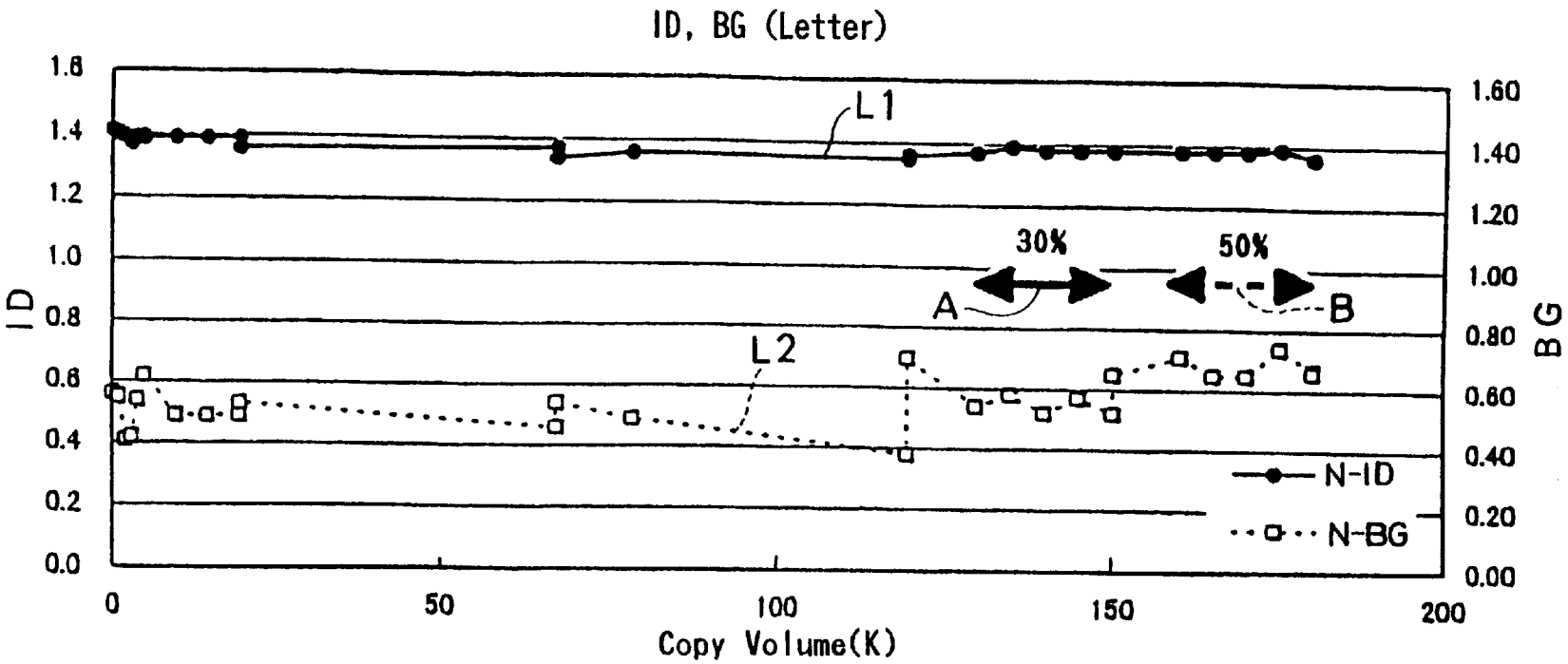
FIG. 26 is a graph showing a relationship between the copy volume (K copy sheets), the formed image density ID, and the ground color fog BG.
Figure 27:
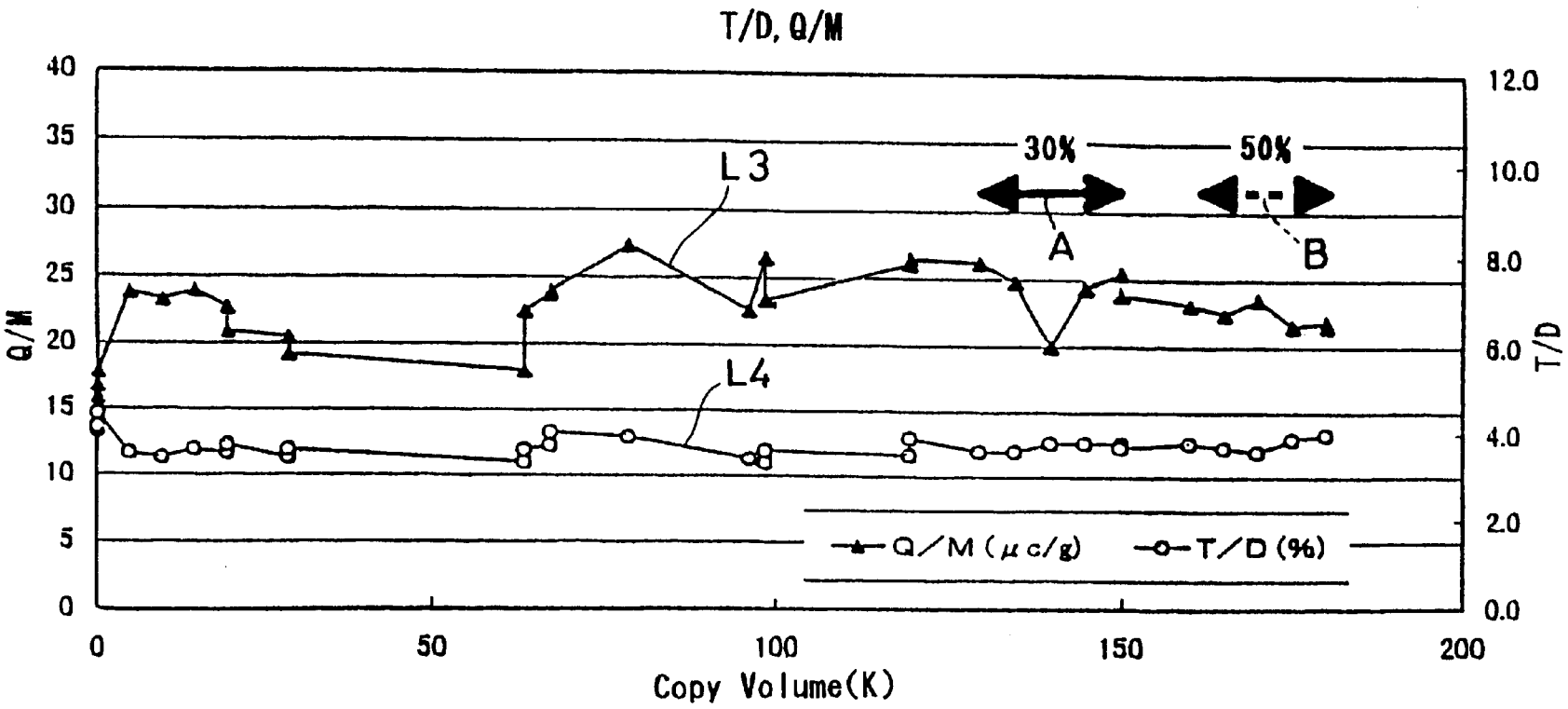
FIG. 27 is a graph showing a relationship between the copy volume (K copy sheets), the toner (developer) concentration Q/M ($\mu$C/g), and the charge amount T/D (%)
Figure 28:
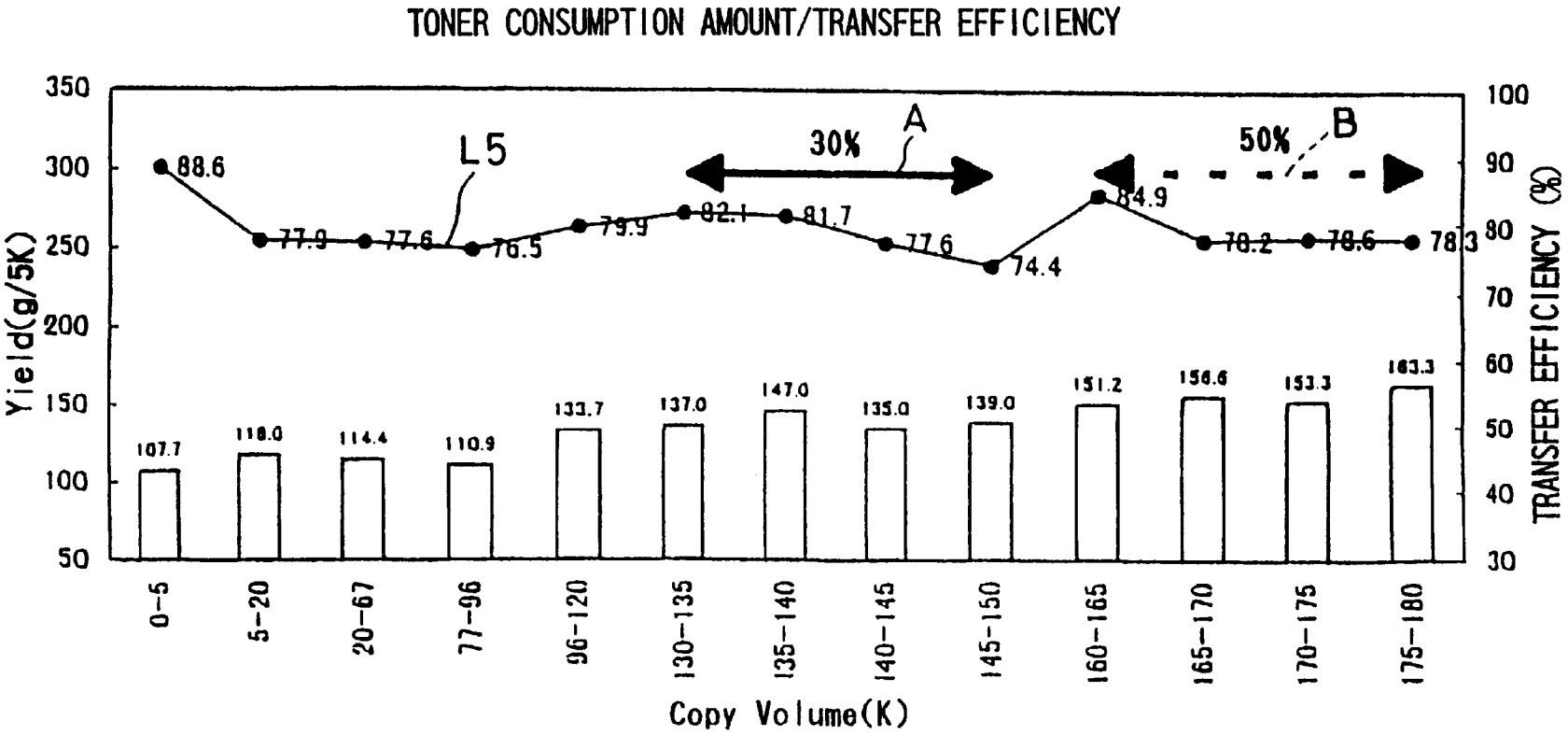
FIG. 28 is a graph showing a relationship between the copy volume (K copy sheets), the toner consumption amount ($\mu$/5K), and the transfer efficiency (%).

FIG. 26 is a graph showing a relationship between the copy volume (K copy sheets), the formed image density ID, and the ground color fog BG. Line L1 indicates the image density ID. Line L2 indicates the ground color fog. FIG. 27 isa graph showing a relationship between the copy volume (K copy sheets), the toner (developer) concentration Q/M ($\mu$C/g), and the charge amount T/D (%). Line L3 indicates the toner (developer) concentration Q/M. Line L4 indicates the charge amount T/D. FIG. 28 is a graph showing a relationship between the copy volume (K copy sheets), the toner consumption amount ($\mu$/5K), and the transfer efficiency (%). The bar graph shows toner consumption amounts. Line L5 indicates the transfer efficiency.

In each of the graphs, in Region A the mixture ratio of fresh toner and collected toner is about 7:3, and in Region B the mixture ratio is about 5:5. In the 7:3 mixture ratio, the characteristics of toner exhibit good transition. However, in the 5:5 mixture ratio, it is proved that the toner characteristics abruptly deteriorate.

As described above, in accordance with the first to third embodiments, the structure of each of the toner supplying rollers 3, 40, 50*a*, and 50*b* becomes relatively simple. A prior art toner supplying roller is integrally formed by winding an elastic body, such as sponge, around a rotary shaft formed by application of nickel or chrome plating onto stainless or carbon steel. It is difficult to carry out such integral formation while changing the type of elastic body along the rotary shaft direction, and only one type of elastic body can be wound around one rotary shaft. However, the toner supplying rollers 3, 40, 50*a*, and 50*b* of the first to third embodiments of the present invention are simple in structure, whereby the toner supplying rollers 3, 40, 50*a*, are 50*b* can be realized easily and inexpensively. Further, even if the elastic bodies 13 and 54 or the elastic members 43 and 56 are changed in type along the rotary shaft direction, it is possible to prevent a difference in level from occurring at a joint. Additionally, the toner supplying rollers 3, 40, 50*a*, and 50*b* can be assembled without making a mistake in elastic body (member) type (the elastic bodies 13 and 54 and the elastic members 43 and 56).

In accordance with the first to third embodiments of the present invention, each of the toner supplying rollers 3, 40, 50*a*, and 50*b* is a toner supplying roller formed by integral formation of a toner supplying roller for fresh toner and a toner supplying roller for collected toner, and a fresh-toner supplying section and a collected-toner supplying section are constructed such that a toner supplying roller for fresh toner and a toner supplying roller for collected toner can be arranged on the same rotational axis. For example, in a developing unit having the toner supplying rollers 3, 40, 50*a*, and 50*b*, activation and shutdown operations are carried out according to the toner concentration of a developer in the developing unit for the rotational control of only one shaft of the toner supplying rollers 3, 40, 50*a*, and 50*b*. Rotary drive is turned on or off and the number of revolutions is determined while monitoring the relationship in magnitude between an output voltage value from a toner concentration sensor 26 and a predetermined reference voltage value. For example, if an output voltage value of the toner concentration sensor 26 exceeds the predetermined reference voltage value, rotary drive is turned on for activation. On the other hand, if an output voltage value of the toner concentration sensor 26 falls below the predetermined reference voltage value, rotary drive is turned off for shutdown. If in the developing unit two shafts are driven independently of each other, this not only results in an increased number of components but also complicates drive sources and the control of rotation. On the other hand, if only one shaft is driven alone, this not only results in a decreased number of components but also simplifies the drive sources and the control of rotation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing unit comprising:

developing means for depositing a developer on a latent image formed on an image carrier to develop the latent image, developer supplying means for supplying the developer to the developing means, developer collecting means for collecting residual developer remaining on the image carrier and delivering the collected residual developer to the developer supplying means, wherein the developer supplying means includes a developer housing and a developer supplying roller, wherein the developer housing has an outlet through which the developer held in the developer housing is discharged, and is divided by a partitioning member into two housing parts of which one of the two housing parts stores fresh developer and the other of the two housing parts stores the collected residual developer, wherein the partitioning member has openings in communication with the outlet so that each of the fresh developer and the collected residual developer is discharged through the outlet, and wherein the developer supplying roller is disposed to confront the outlet of the developer housing, and includes a single rotary shaft and a plurality of composite members fit to the rotary shaft, wherein each of the plurality of composite members comprise a cylindrical hollow body and a cylindrical elastic body fit to an outer peripheral surface of the hollow body, and each of the composite members are located adjacent to the two housing parts.

2. The developing unit of claim 1, wherein the elastic bodies of the plurality of composite members are formed of different cellular materials having different cell densities.

3. The developing unit of claim 1, wherein there is formed an engaging portion at both ends of the respective hollow bodies of the composite members, for linking the hollow bodies together.

4. The developing unit of claim 1, wherein the rotary shaft and the respective hollow bodies are provided with a slip-preventing member so that the hollow bodies fit to the rotary shaft are prevented from slipping.

5. The developing unit of claim 1, wherein adjoining end surfaces of the elastic bodies of the composite members are adhered to each other.

6. The developing unit of claim 1, wherein an end surface of the elastic body of each composite member projects beyond an end surface of the hollow body of the composite member.

7. An image forming apparatus comprising the developing unit of claim 1.

8. A developing unit comprising:

developing means for depositing a developer on a latent image formed on an image carrier to develop the latent image, developer supplying means for supplying the developer to the developing means, developer collecting means for collecting residual developer remaining on the image carrier and delivering the collected residual developer to the developer supplying means, wherein the developer supplying means includes a developer housing and a developer supplying roller, wherein the developer housing has an outlet through which the developer held in the developer housing is discharged, and is divided by a partitioning member into two housing parts of which one of the two housing parts stores fresh developer and the other of the two housing parts stores the collected residual developer, wherein the partitioning member has openings in communication with the outlet so that each of the fresh developer and the collected residual developer is discharged through the outlet, and wherein the developer supplying roller is disposed to confront the outlet of the developer housing, and includes rotary shaft members which are linked to each other to form a rotary shaft, and a plurality of elastic members fit to the rotary shaft member, respectively, and each one of the elastic members are located adjacent to the two housing parts.

9. The developing unit of claim 8, wherein the elastic members are formed of different cellular materials having different cell densities.

10. The developing unit of claim 8, wherein adjoining end surfaces of the elastic members are adhered to each other.

11. The developing unit of claim 8, wherein an end surface of each one of the elastic member projects beyond an end surface of the rotary shaft members.

12. An image forming apparatus comprising the developing unit of claim 7.

* * * * *